US012201871B2

(12) United States Patent
Bolden

(10) Patent No.: US 12,201,871 B2
(45) Date of Patent: Jan. 21, 2025

(54) EXERCISE APPARATUS COMPRISING INNER AND OUTER GLIDERS

(71) Applicant: Jon Bolden, Seattle, WA (US)

(72) Inventor: Jon Bolden, Seattle, WA (US)

( * ) Notice: Subject to any disclaimer, the term of this patent is extended or adjusted under 35 U.S.C. 154(b) by 130 days.

(21) Appl. No.: 17/878,864

(22) Filed: Aug. 1, 2022

(65) Prior Publication Data

US 2023/0405390 A1 Dec. 21, 2023

Related U.S. Application Data

(60) Provisional application No. 63/227,641, filed on Jul. 30, 2021.

(51) Int. Cl.
*A63B 21/00* (2006.01)
*A63B 21/062* (2006.01)

(52) U.S. Cl.
CPC ..... *A63B 21/154* (2013.01); *A63B 21/063* (2015.10)

(58) Field of Classification Search
CPC ... A63B 21/154; A63B 21/063; A63B 21/151; A63B 2071/025; A63B 23/03575; A63B 21/4034; A63B 21/4049; A63B 21/4035; A63B 2210/50; A63B 2225/09; A63B 21/0628
See application file for complete search history.

(56) References Cited

U.S. PATENT DOCUMENTS 3,721,438 A * 3/1973 Kusmer ..... A63B 22/0002 482/56
4,603,855 A * 8/1986 Sebelle ..... A63B 21/06 482/133
4,640,268 A 2/1987 Roberts
4,898,381 A * 2/1990 Gordon ..... A63B 23/03533 482/103
5,018,725 A * 5/1991 Cook ..... A63B 21/4035 482/142
5,190,509 A 3/1993 Davison, Jr.
5,211,614 A * 5/1993 Henes ..... A63B 21/0628 482/133
5,725,459 A * 3/1998 Rexach ..... A63B 23/03566 482/92
6,102,836 A 8/2000 Person
6,165,110 A 12/2000 Gajda
6,447,430 B1 * 9/2002 Webb ..... A63B 23/00 482/93
6,685,600 B1 * 2/2004 Ullman ..... A63B 21/156 482/138

(Continued)

*Primary Examiner* — Andrew S Lo
(74) *Attorney, Agent, or Firm* — Malloy & Malloy, P.L.; Rafay Asrar

(57) ABSTRACT

An exercise apparatus suitable for promoting Long Strength Development (LSD) in an exerciser may include an apparatus frame. At least one pair of left and right outer gliders and at least one pair of left and right inner gliders may be pivotally mounted on the apparatus frame, the inner gliders arranged inside the outer gliders. The outer gliders and the inner gliders may be independently positional between an outwardly extended position and an inwardly retracted position. A weight rack may be provided on the apparatus frame and may be connected to the outer gliders and the inner gliders through a cable and pulley system. The weight rack may be selectively connectable to the inner and outer gliders.

20 Claims, 19 Drawing Sheets

(56) References Cited

U.S. PATENT DOCUMENTS 7,632,221 B1 * 12/2009 Kolander ..... A63B 23/03525 482/102
7,651,443 B1 * 1/2010 Fenster ..... A63B 71/0036 482/37
7,717,833 B1 * 5/2010 Nelson ..... A63B 21/15 482/137
7,722,509 B2 5/2010 Eder
7,771,323 B1 * 8/2010 Batca ..... A63B 21/4035 482/142
7,833,138 B1 * 11/2010 Fulks ..... A63B 23/12 482/136
7,887,471 B2 * 2/2011 McSorley ..... A63B 21/0552 482/136
8,172,733 B1 * 5/2012 Batca ..... A63B 21/0628 482/99
8,246,524 B2 8/2012 Castillo
8,506,459 B2 * 8/2013 Cassidy ..... A63B 23/0355 482/102
9,192,799 B2 * 11/2015 Alenaddaf ..... A63B 71/0036
9,211,434 B2 * 12/2015 Giannelli ..... A63B 21/156
9,302,136 B2 4/2016 Lyszczarz
9,573,011 B1 * 2/2017 Nasta ..... G06Q 30/0241
9,802,075 B2 10/2017 Gvoich
9,814,928 B2 11/2017 Taylor et al.
10,350,445 B2 * 7/2019 Hockridge ..... A63B 23/03541
10,709,925 B2 7/2020 Dalebout et al.
10,953,301 B2 * 3/2021 Brasch ..... A63B 1/00
11,446,535 B1 * 9/2022 Iverson ..... A63B 17/02
2003/0114281 A1 * 6/2003 Mackert ..... A63B 21/159 482/142
2004/0033863 A1 2/2004 Carlson
2004/0147376 A1 7/2004 Gautier
2006/0160677 A1 7/2006 Piane, Jr.
2006/0240956 A1 10/2006 Piane, Jr.
2010/0190617 A1 * 7/2010 Gautier ..... A63B 21/4047 482/94
2012/0225760 A1 * 9/2012 Webb ..... A63B 21/072 482/139
2013/0065737 A1 * 3/2013 Habing ..... A63B 21/0628 482/102
2013/0109543 A1 * 5/2013 Reyes ..... A63B 21/4035 482/99
2014/0194260 A1 7/2014 Campanaro et al.
2015/0246258 A1 * 9/2015 Hockridge ..... A63B 21/156 482/99
2016/0346590 A1 * 12/2016 Giannelli ..... A63B 21/4035
2019/0134450 A1 * 5/2019 Kuo ..... A63B 21/154
2019/0269955 A1 9/2019 Budylina
2020/0047025 A1 * 2/2020 Bobin ..... A63B 21/154

* cited by examiner

EXERCISE APPARATUS COMPRISING INNER AND OUTER GLIDERS

FIELD OF THE INVENTION

The present invention relates generally to exercise apparatuses, and more particularly, to an exercise apparatus which can be used to promote Long Strength Development (LSD) in an exerciser.

BACKGROUND OF THE INVENTION

Exercise is an activity that enhances or maintains physical fitness and overall health and wellness. Exercise can improve strength, retard aging, facilitate muscular development and strengthen the cardiovascular system as well as hone athletic skills and facilitate weight loss or maintenance. Furthermore, exercise contributes to reduce stress and relax the mind. Exercise can be conducted either indoors or outdoors in a wide variety of modalities.

The basic types of exercise are aerobic exercise, anaerobic exercise, and flexibility exercises. Aerobic exercise includes any type of physical activity that utilizes large muscle groups, elevates the heart rate, and causes the body to consume more oxygen than it would at rest. One of the purposes of aerobic exercise is to increase cardiovascular fitness. Examples of aerobic exercise include running, cycling, swimming, brisk walking, jumping rope, rowing, hiking, and playing tennis.

Anaerobic exercise includes strength and resistance training and can firm, strengthen, and increase muscle mass and improve bone density, balance, and coordination. Push-ups, pull-ups, lunges, and weight training such as weightlifting, bench press, squats are examples of anaerobic exercise.

Flexibility exercises are slow and carefully timed bodily movements which are undertaken to stretch and lengthen targeted muscles. Flexibility exercises improve joint flexibility and keep muscles limber. Improving joint flexibility improves the range of motion of a joint, thereby reducing the chance of injury.

While multiple apparatus are known in the art for carrying out the aforementioned different types of exercises, there remains a need in the art for an improved exercise apparatus which may promote Long Strength Development (LSD), which consists in maximizing non-primary-muscles that contribute to allowing the primary muscles and secondary muscles to function properly with minimum compensation of muscles that may have been taking on such responsibilities.

SUMMARY OF THE INVENTION

The present invention is directed to an exercise apparatus which may promote Long Strength Development (LSD) in an exerciser.

In an illustrative implementation of the invention, the exercise apparatus may include an apparatus frame. At least one pair of left and right pair outer gliders may be pivotally mounted on the apparatus frame. At least one pair of left and right inner gliders may be pivotally mounted on the apparatus frame inside the left and right outer gliders, respectively. The outer gliders and the inner gliders may be independently positional between an outwardly extended position and an inwardly retracted position. A weight rack may be provided on the apparatus frame. The weight rack may be selectively connectable to the inner and outer gliders.

In a second aspect, at least one cable and pulley system may connect the weight plates of the weight rack to the outer gliders and the inner gliders. The cable and pulley system may include a weight resistance cable and pulley system which connects the weight plates to a first one of the inner gliders and the outer gliders and a counterweight resistance cable and pulley system which connects the weight plates to a second one of the inner gliders and the outer gliders. The number of the stacked weight plates of the weight rack can be selected for a particular exercise to vary the resistance of the gliders as the exerciser sits or stands between the paired left and right gliders and uses his or her arms and/or legs to move the gliders in an arc between the extended and retracted positions.

In another aspect, the first one of the outer gliders and the inner gliders may utilize weight resistance for sagittal and transverse functionality, and a second one of the outer gliders and the inner gliders may utilize counterweight or balance resistance, to impart resistance to the arms and/or legs of the exerciser.

In another aspect, the apparatus frame may include a frame base and a frame upright extending upwardly from the frame base, and the outer gliders and the inner gliders may be pivotally mounted on the frame base and the frame upright.

In another aspect, the frame base of the apparatus frame may include a rear base segment and a front base segment extending from the rear base segment.

In another aspect, the rear base segment may be straight and elongated and the front base segment may be curved or semicircular.

In yet another aspect, exercise apparatus may be selectively deployable in an extended, functional configuration and a folded, transport or storage configuration.

In another aspect, a pair of front base segment hinges may be provided in the front base segment to facilitate selective deployment of the exercise apparatus in the extended, functional configuration and the folded, transport or storage configuration.

In another aspect, the frame upright may extend from substantially the midpoint of the rear base segment of the frame base.

In another aspect, a weight rack platform may be provided on the rear base segment of the frame base, and the weight rack may be provided on the weight rack platform behind the frame upright.

In yet another aspect, the weight rack may include at least one vertical rack rail, and the weight plates may be slidably mounted on the at least one rack rail.

In another aspect, the at least one rack rail may include a pair of spaced-apart side rack rails.

In another aspect, the at least one rack rail may include a center rack rail between the side rack rails.

In another aspect, the apparatus frame may include at least one glider support, and the outer gliders and the inner gliders may be pivotally attached to the at least one glider support.

In yet another aspect, the at least one glider support may include a base glider support on the frame base of the apparatus frame.

In another aspect, the at least one glider support may include at least one overhead glider support on the frame upright.

In another aspect, the at least one glider support may include a lower overhead glider support and an upper overhead glider support, and the inner gliders may be pivotally attached to the lower overhead glider support and the outer gliders may be pivotally attached to the upper overhead glider support.

In another aspect, a pair of frame arms may extend upwardly from the frame upright, and the lower overhead glider support and the upper overhead glider support may be supported by the frame arms.

In yet another aspect, at east one wheel may be provided on the frame base of the apparatus frame.

In another aspect, the at least one wheel may be provided on the rear base segment of the frame base.

In another aspect, a seat may be provided on the frame upright of the apparatus frame.

In another aspect, a backrest may be provided on the frame uptight above the seat.

In yet another aspect, the seat may be selectively deployable between a flat, stowage position and an extended, functional position.

In another aspect, the inner gliders may be connected to the weight and resistance pulley system and the outer gliders may be connected to the counterweight resistance weight and pulley system.

In another aspect, the inner gliders may include a pair of lower inner gliders pivotally attached to the base glider support on the frame base of the apparatus frame.

In another aspect, the inner gliders may include a pair of upper inner gliders pivotally attached to the lower overhead glider support on the frame upright of the apparatus frame.

In yet another aspect, the inner gliders may include a pair of lower inner gliders pivotally attached to the base glider support on the frame base and a pair of upper inner gliders pivotally attached to the lower overhead glider support on the frame upright of the apparatus frame.

In another aspect, the lower inner gliders and the upper inner gliders may be independently pivotal with respect to the apparatus frame.

In another aspect, each of the pair of inner gliders may include a proximal segment, a distal segment extending at an angle from the proximal segment and a mount flange terminating the proximal segment. The mount flange may be suitably configured for pivotal attachment to the corresponding base glider support or lower overhead glider support.

In another aspect, a glider connecting member may be attached to each left or right upper inner glider and each corresponding left or right lower inner glider for movement of each left upper and lower inner glider and each right upper and lower inner glider in concert with each other.

In another aspect, each of the outer gliders may include a lower glider segment pivotally attached to the base glider support, an upper glider segment pivotally attached to the lower overhead glider support and an outer glider segment extending between the lower glider segment and the upper glider segment.

In yet another aspect, the outer glider segment of each outer glider may be curved outwardly.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward an exercise apparatus which can be used to promote Long Strength Development (LSD) in an exerciser. Shown throughout the figures is an illustrative and non-limiting example of the invention, hereinafter referred to as exercise apparatus 100.

Figure 1:
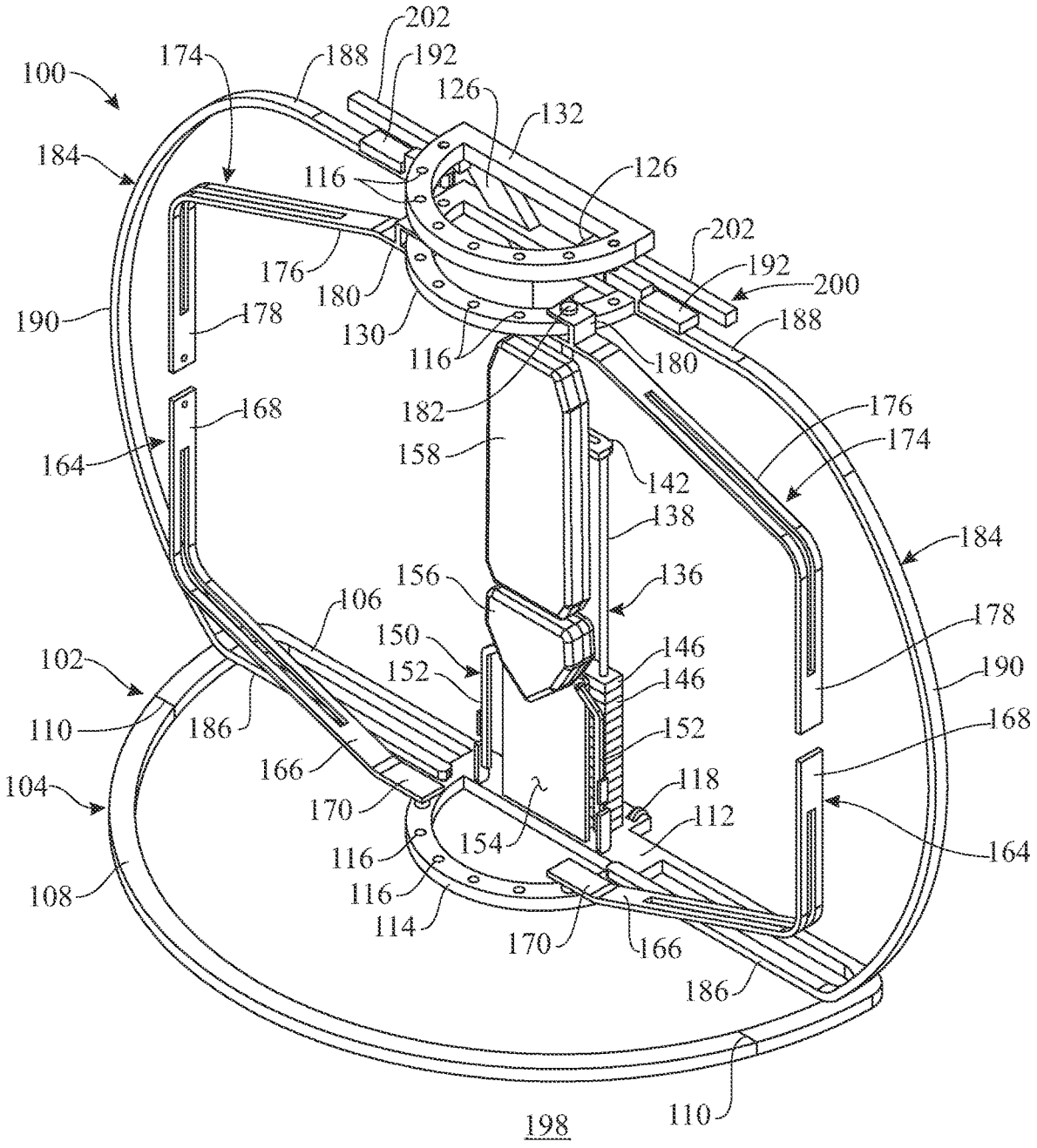
FIG. 1 presents a top front isometric view of an exercise apparatus in accordance with an illustrative embodiment of the present invention, with the outer gliders and the inner gliders deployed in the outwardly extended position.
Figure 2:
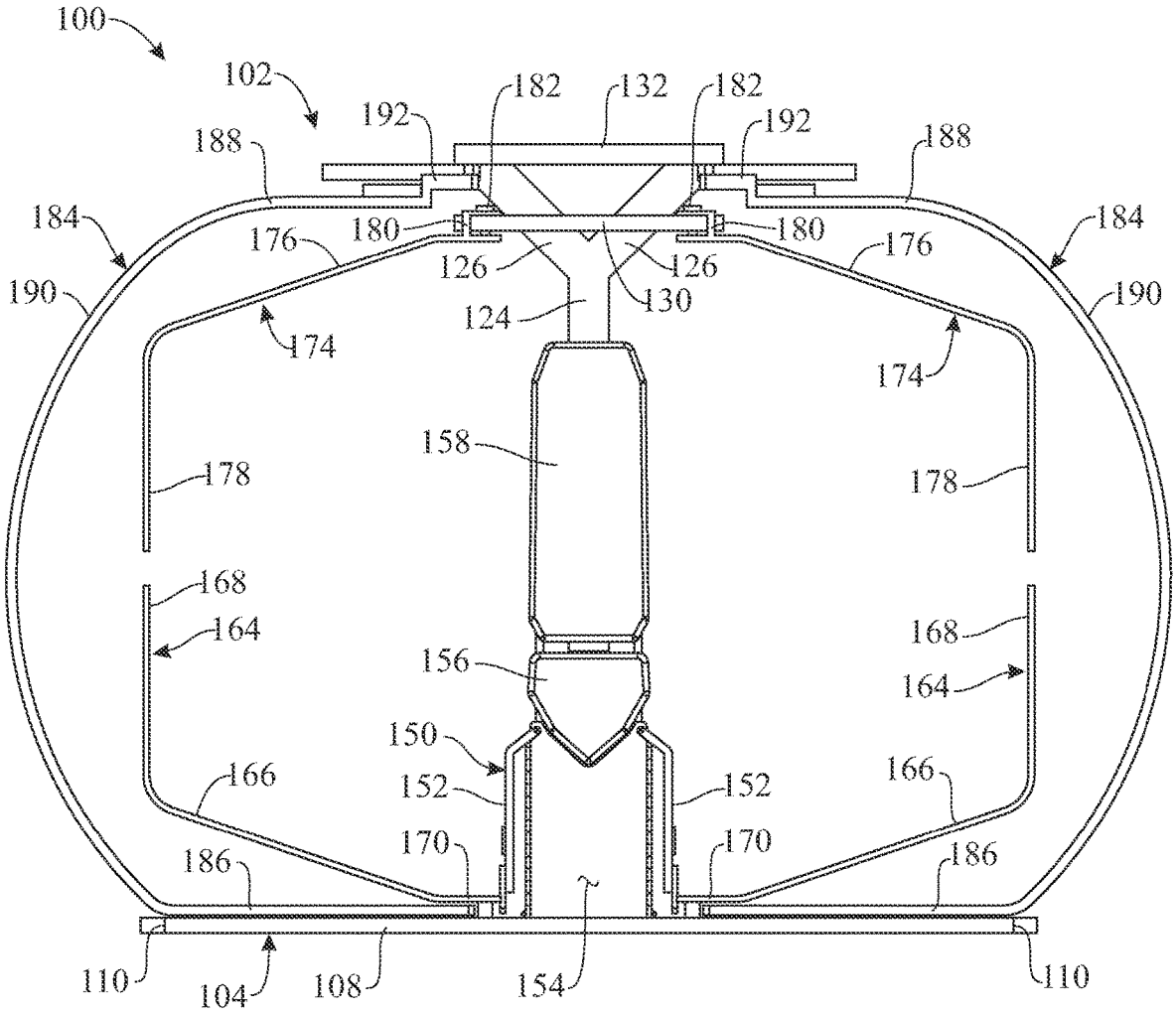
FIG. 2 presents a front elevation view of the exercise apparatus of FIG. 1.

Referring initially to FIG. 1, the exercise apparatus 100 may include an apparatus frame 102. At least one left and right pair of outer gliders 184 may be pivotally mounted on the apparatus frame 102. At least one left and right pair of inner gliders 164, 174 may be pivotally mounted on the apparatus frame 102 inside the left and right pair of outer gliders 184, respectively, as best shown in FIG. 2. The outer gliders 184 and the inner gliders 164, 174 may be independently positional between a rearward and outwardly-extended position and a forward and inwardly-retracted position.

With continued reference to FIG. 1, a weight rack 136 may be provided on the apparatus frame 102. The weight rack 136 may include multiple stacked weight plates 146, best shown in FIG. 3. At least one cable and pulley system (not illustrated in order not to obscure the invention) may connect the weight plates 146 of the weight rack 136 to the outer gliders 184 and the inner gliders 164, 174. In some embodiments, the cable and pulley system may include a weight resistance cable and pulley system which connects the weight plates 146 to a first one of the inner gliders 164, 174 and the outer gliders 184 and a counterweight resistance cable and pulley system (not illustrated in order not to obscure the invention) which connects the weight plates 146 to a second one of the inner gliders 164, 174 and the outer gliders 184. The number of the stacked weight plates 146 of the weight rack 136 can be selected for a particular exercise to vary the resistance of the inner gliders 164, 174 and the outer gliders 184 as an exerciser sits or stands between the paired left and right inner gliders 164, 174 and outer gliders 184 and uses his or her arms and/or legs to move the inner gliders 164, 174 and the outer gliders 184 in an arc between the extended and retracted positions. In some embodiments, the first one of the outer gliders 184 and the inner gliders 164, 174 may utilize weight resistance for sagittal and transverse functionality. In some embodiments, a second one of the outer gliders 184 and the inner gliders 164, 174 may utilize counterweight or balance resistance to impart resistance to the arms and/or legs of the exerciser.

Figure 3:
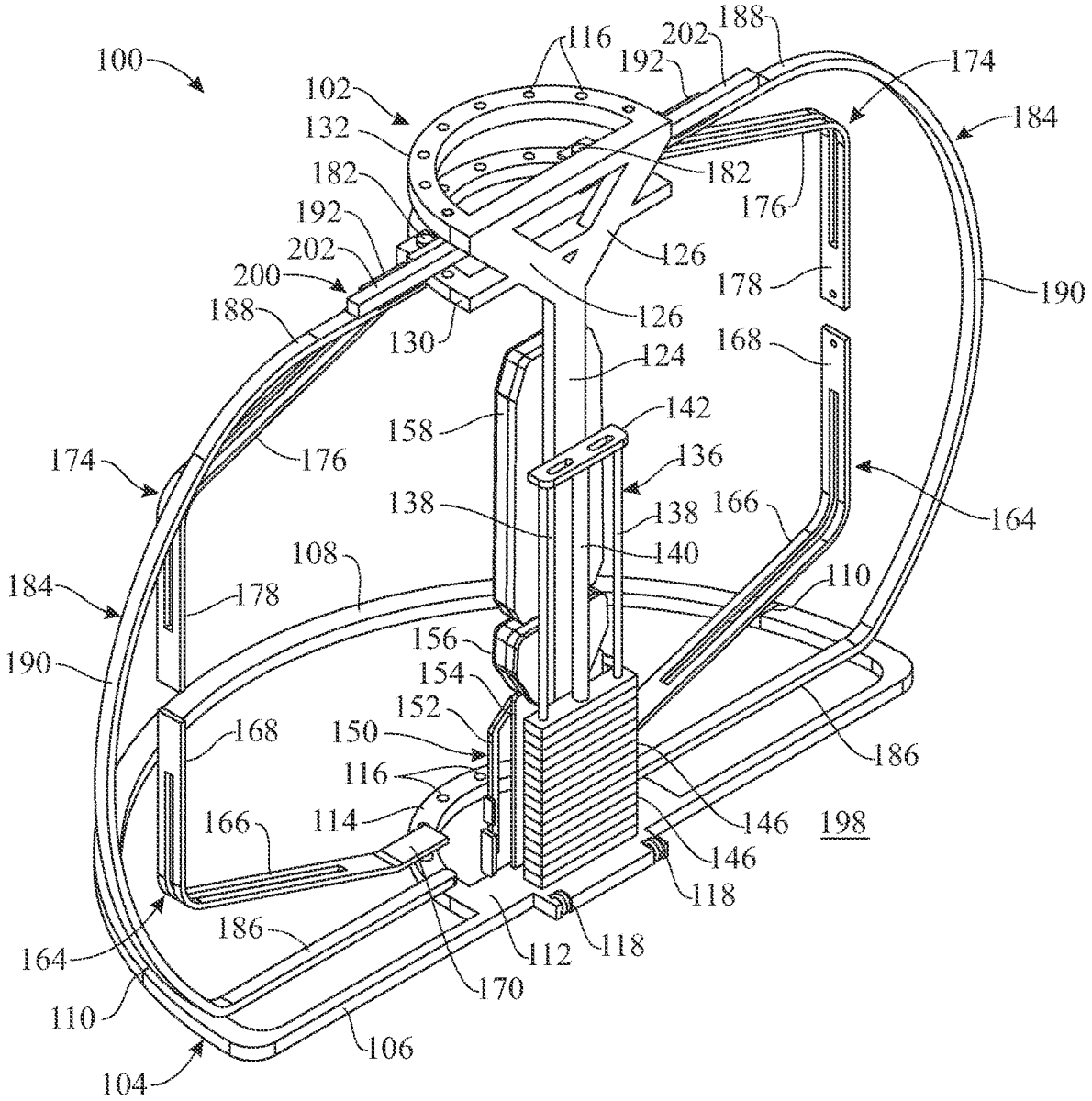
FIG. 3 presents a top rear isometric view of the exercise apparatus of FIG. 1.
Figure 4:
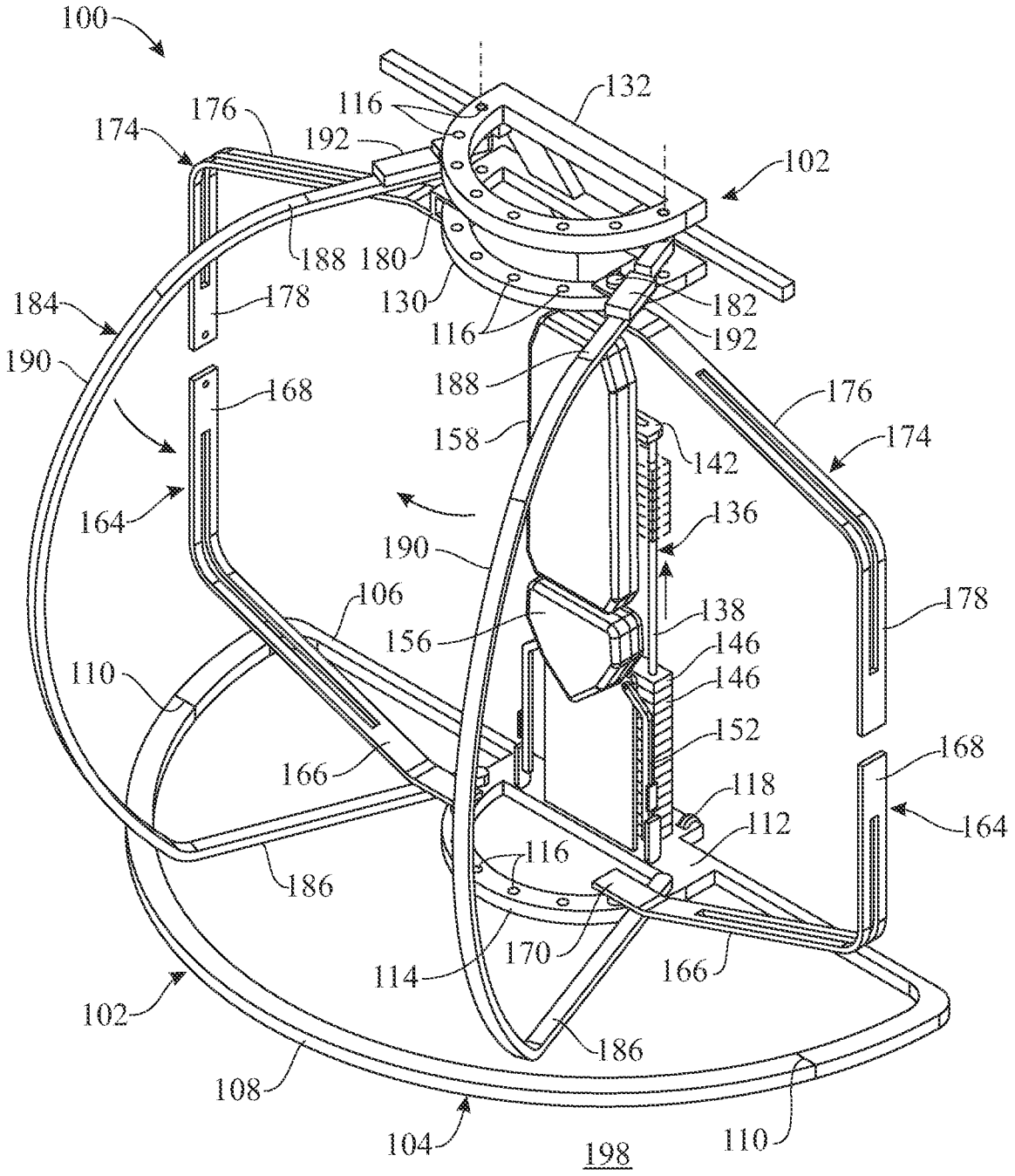
FIG. 4 presents a top front isometric view of the exercise apparatus of FIG. 1, with the outer gliders deployed in the inwardly retracted position and the inner gliders deployed in the outwardly extended position.

In some embodiments, the apparatus frame 102 may include a frame base 104. The frame base 104 may extend along a front-to-back, longitudinal direction x and a left-to-right, transverse direction y of the exercise apparatus 100. As best shown in FIG. 3, a frame upright 124 may extend upwardly from the frame base 104, preferably in a vertical direction z which is perpendicular to the longitudinal and transverse directions x and y. The frame upright 124 may be fixedly attached to the frame base 104. The outer gliders 184 and the inner gliders 164, 174 may be pivotally mounted on the frame base 104 and the frame upright 124, as will be hereinafter described.

The frame base 104 may have any design which is suitable for supporting the apparatus frame 102 in an upright position on a flat floor or other support surface generally arranged along a horizontal (x-y) plane. In some embodiments, the frame base 104 of the apparatus frame 102 may include a rear base segment 106. In some embodiments, a front base segment 108 may extend from the rear base segment 106. The rear base segment 106 may be straight and elongated. The front base segment 108 may be polygonal, curved, or combinations thereof. For instance and without limitation, the front base segment 108 of may be circular (e.g., semicircular, as shown). In some embodiments, the rear and front base segments 106 and 108 may form a D-shaped arrangement, facilitating placement of the exercise apparatus 100 adjacent to a wall or other vertical structure or surface.

Figure 13:
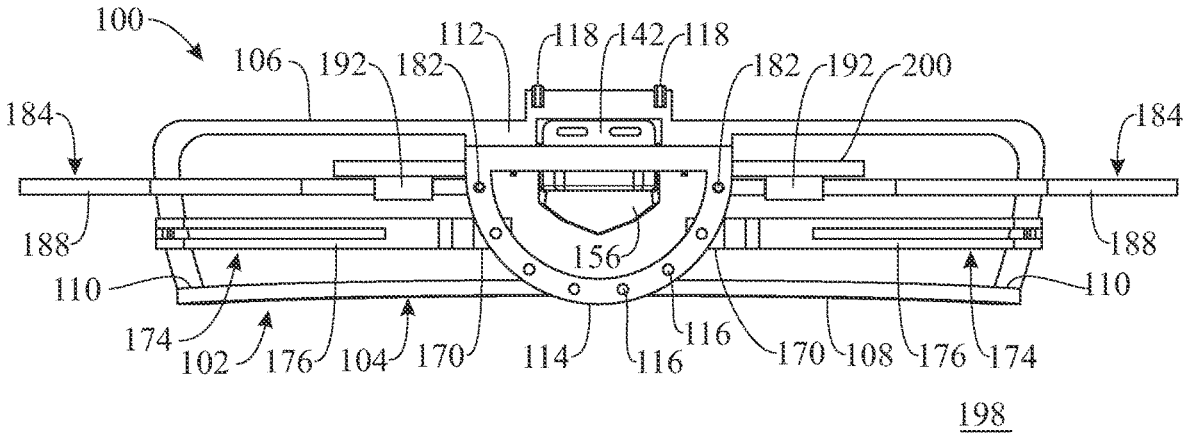
FIG. 13 presents a top plan view of the exercise apparatus of FIG. 1, in the transport or storage configuration
Figure 14:
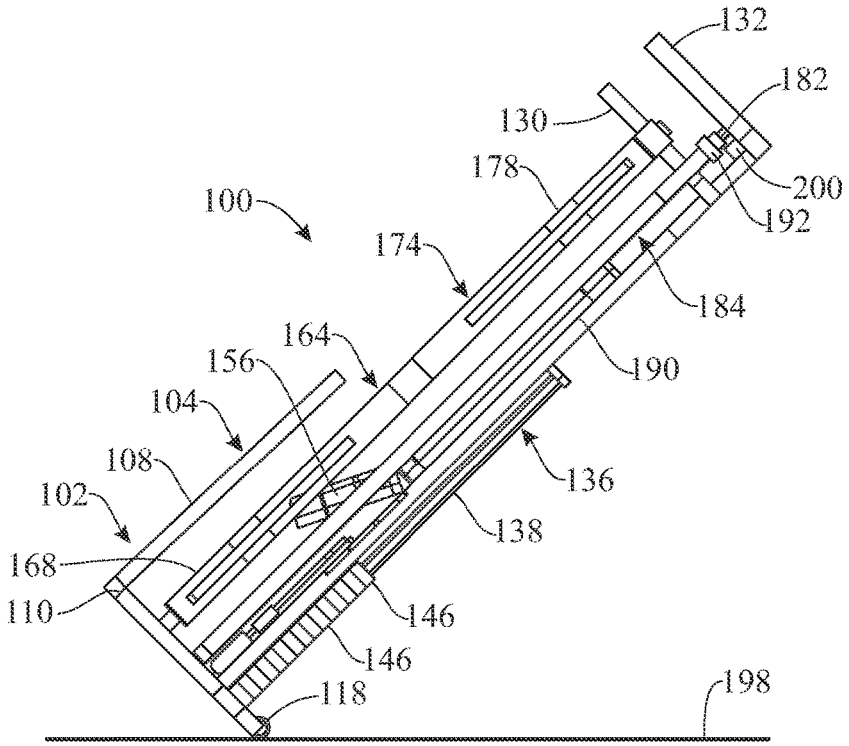
FIG. 14 presents a side elevation view of the exercise apparatus of FIG. 1 in the transport or storage configuration, more particularly illustrating transport of the exercise apparatus on a surface via the wheels.

In some embodiments, the exercise apparatus 100 may be selectively deployable in an extended, functional configuration and a folded, transport or storage configuration (FIGS. 13 and 14). In the extended, functional configuration, the frame base 104 may extend fully outward relative to the frame upright 124, maximizing stability provided by the frame base 104. In the folded, transport or storage configuration, the frame base 104 may be collapsed. For instance, pair of front base segment hinges 110 may be provided in the front base segment 108. The front base segment hinges 110 may facilitate collapsing or folding the frame base 104, and thus facilitate selective deployment of the exercise apparatus in the extended, functional configuration and the folded, transport or storage configuration.

Figure 10:
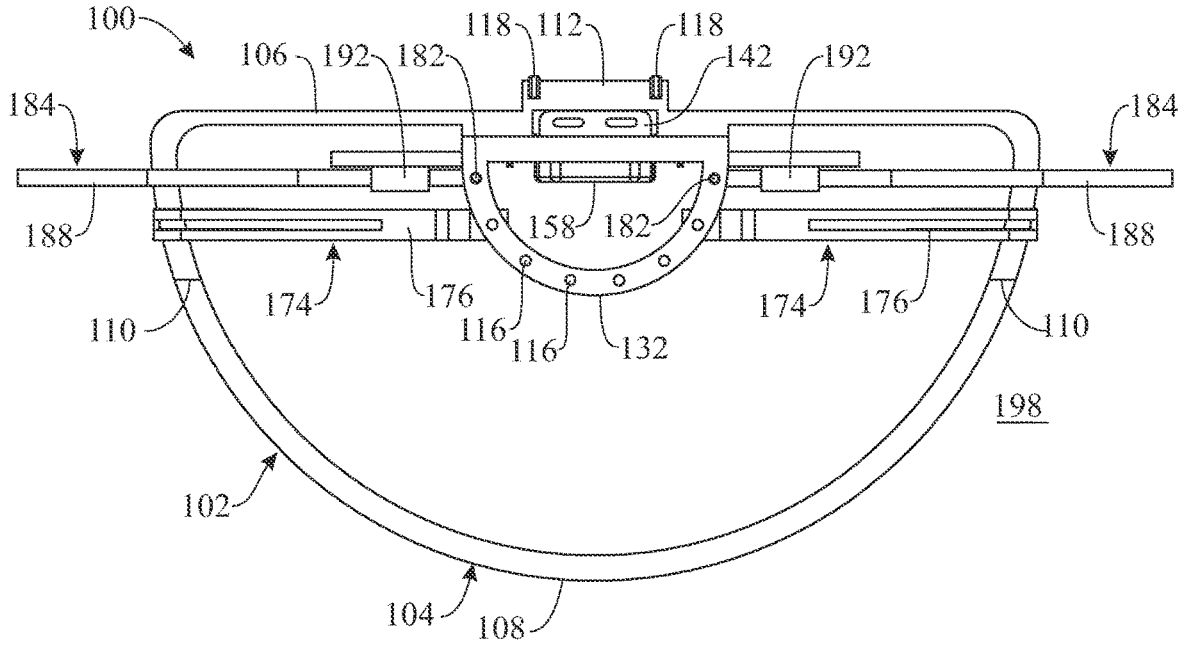
FIG. 10 presents a top plan view of the exercise apparatus of FIG. 1, with the outer and inner gliders deployed in the outwardly extended position.
Figure 11:
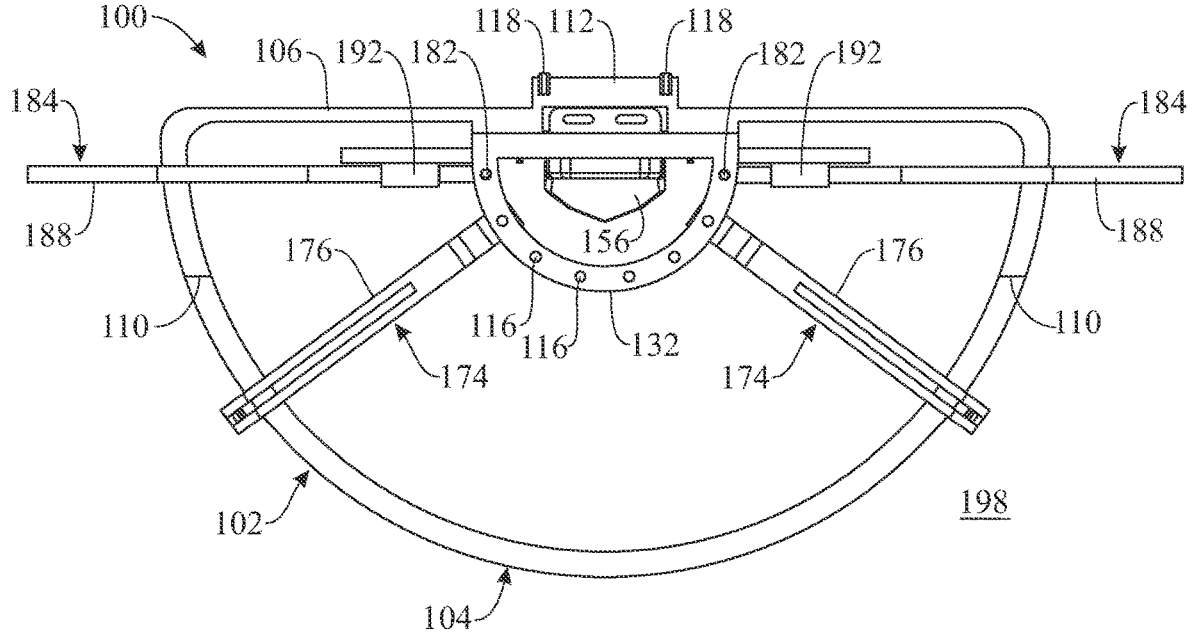
FIG. 11 presents a top plan view of the exercise apparatus of FIG. 1, with the outer gliders deployed in the outwardly extended position and the inner gliders deployed in the inwardly retracted position.
Figure 12:
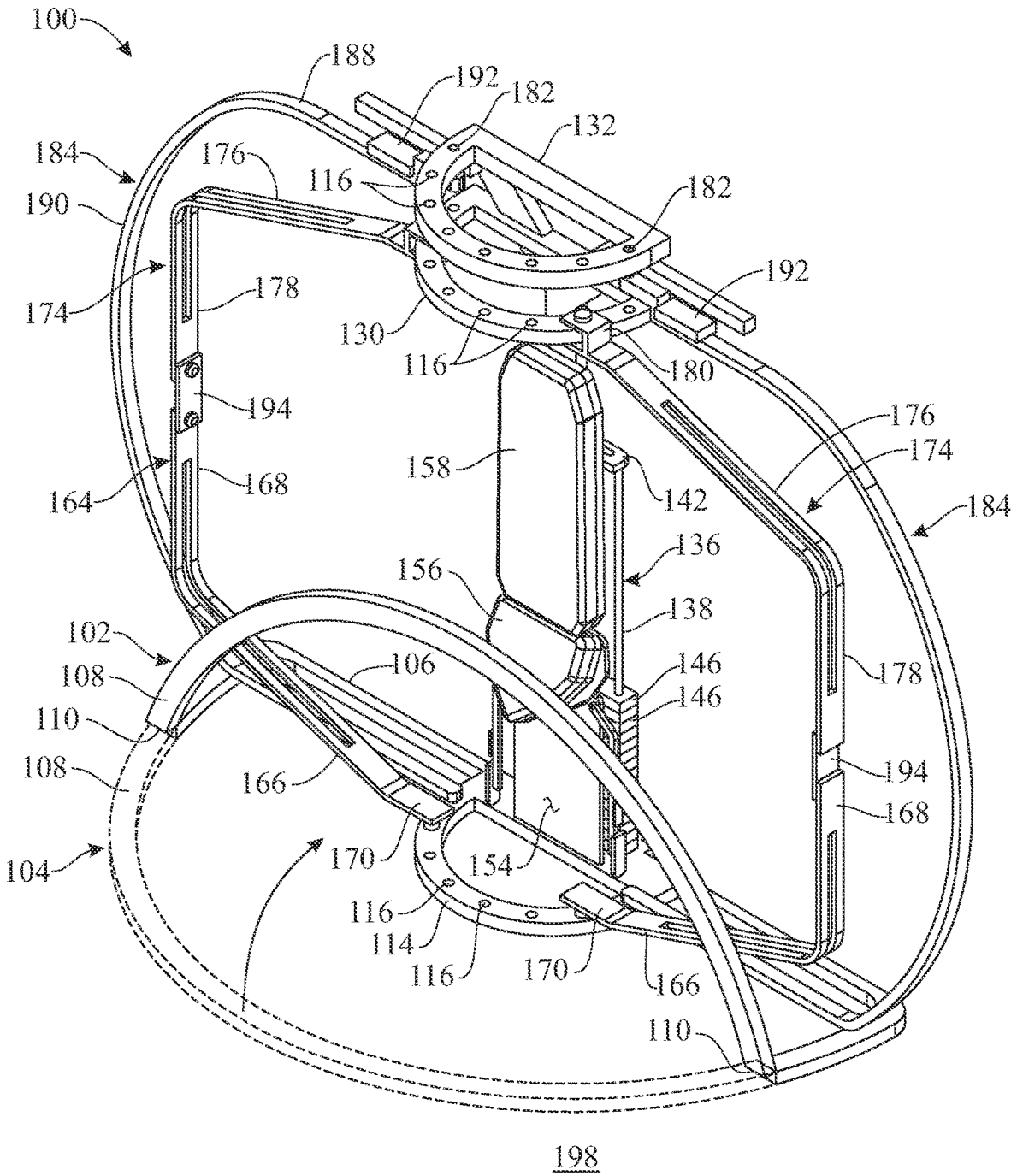
FIG. 12 presents a top front isometric view of the exercise apparatus of FIG. 1, more particularly illustrating foldability of the front base segment to facilitate deployment of the exercise apparatus between the extended, functional configuration and the folded, transport or storage configuration.

As illustrated in FIG. 3, in some embodiments, the frame upright 124 may extend from substantially the midpoint of the rear base segment 106 of the frame base 104. Alternatively or additionally, the frame upright 124 may extend from, or be in vertical alignment with, substantially the center of the circular or otherwise curved or otherwise shaped front base segment 106 when observed in top plan view. In some embodiments, such as the present embodiment, all said features are included, i.e. the center of the front base segment 108 is located substantially at the midpoint of the rear base segment 106, as best shown in FIG. 10, maximizing stability of the exercise apparatus 100 in different lateral directions along the x-y plane.

With continued reference to FIG. 3, the rear base segment 106 of the frame base 104 may include a widened central area or weight rack platform 112. The weight rack 136 may be provided on the weight rack platform 112 behind the frame upright 124.

The weight rack 136 may have any design which is suitable for the purpose of supporting the weight plates 146 in vertical relationship to each other and vertically movable along the weight rack 136. As further illustrated in FIG. 3, in some embodiments, the weight rack 136 may include at least one vertical rack rail 138, 140. The weight plates 146 may be slidably mounted on the at least one rack rail 138, 140. The at least one vertical rack rail 138, 140 may include a pair of spaced-apart side rack rails 138 and may further include a center rack rail 140 extending between the side rack rails 138. An elongated rail connector 142 may terminate the upper ends of and connect the side rack rails 138 and the center rack rail 140 to each other.

With reference to FIGS. 1 and 2, the apparatus frame 102 may include at least one glider support, to which the outer gliders 184 and the inner gliders 164, 174 may be pivotally attached. For instance and without limitation, the at least one glider support may include a base glider support 114, an upper overhead glider support 132, and a lower overhead glider support 130. The base glider support 114 may be provided on the frame base 104 of the apparatus frame 102. The lower overhead glider support 130 and upper overhead glider support 132 may be provided on and carried by the frame upright 124, in spaced-apart relationship with the base glider support 114. The inner gliders 164, 174 may be pivotally attached to the base glider support 114 and the lower overhead glider support 130. The outer gliders 184 may be pivotally attached to the base glider support 114 and the upper overhead glider support 132. In some embodiments, at least one, and more preferably, all of the glider supports 114, 130 and 132 may be generally arched, such as circular, and optionally concentric to the front base segment 108. As best shown in FIG. 2, the glider supports 114, 130 and 132 may be parallel to one another and configured to be horizontally arranged when the frame base 104 rests on a horizontal floor or surface. In some preferred embodiments, the glider supports 114, 130 and 132 form part of the apparatus frame 102, i.e. are fixed non-movable relative to the rear base segment 106 and the frame upright 124 of the apparatus frame 102.

As illustrated in FIG. 3, in some embodiments, the frame upright 124 may include a pair of frame arms 126 at a top area thereof. The frame arms 136 may be arranged in a V-shaped relationship with one another and forming a Y-shape arrangement with the frame upright 124. The lower overhead glider support 130 and the upper overhead glider support 132 may be supported by the frame arms 126.

In some embodiments, the inner gliders 164, 174 and the outer glider 184 may be selectively mounted at different points along the length of the base glider support 114, the lower overhead glider support 130 and the upper overhead glider support 132. In some embodiments, the glider supports 114, 130 and 132 may include discrete mounting points for selectively mounting the inner gliders 164, 174 and the outer glider 184 and specific, discrete positions therealong. For instance and without limitation, the discrete mounting points may include multiple glider mount openings 116 provided in each glider support 114, 130, 132, and respective pivot pins 182 attaching each inner glider 164, 174 and outer glider 184 to each corresponding glider support 114, 130, 132.

With continued reference to FIG. 3, in some embodiments, at least one roller or wheel 118 may be provided on the frame base 104 of the apparatus frame 102, to facilitate rolling the exercise apparatus 100 along the floor or other surface. In some embodiments, the wheel or wheels 118 may be arranged in substantial transverse alignment (along transverse direction y) to facilitate frontward and rearward rolling of the exercise apparatus 100. The wheel or wheels 118 may be provided on the rear base segment 106 of the frame base 104. As illustrated in FIG. 14, the wheel or wheels 118 may render the exercise apparatus 100 transportable on a surface 198 in the folded, transport or storage configuration. In some embodiments, such as the present embodiment, frame base 104 is configured to rest on the ground when the exercise apparatus 100 is in the upright, usage position shown in the figures, and rolling mobility of the exercise 100 apparatus by the wheel or wheels 118 is prevented. In this upright, usage position, the wheel or wheels 118 may, however, touch the ground to facilitate tilting the apparatus from the upright, usage position to a tilted, transport position shown in FIG. 14, which will be described in detail hereinafter.

As further shown in FIGS. 1 and 2, a seat 156 may be carried by the frame upright 124 of the apparatus frame 102. A backrest 158 may be provided on the frame upright 124 above the seat 156. The seat 156 and backrest 158, if present, may be arranged between and in spaced-apart relationship with the base, lower overhead and upper overhead glider supports 114, 130 and 132, as best shown in FIG. 2. In some embodiments, the seat 156 may be selectively deployable between a flat, stowage position, shown for instance in FIG. 1, and an extended, functional position, shown for instance in FIG. 7. Preferably, in the extended, functional position, the seat is relatively far from being arranged horizontally; for example, the seat 156 may be arranged forming an angle less than or equal to 30 degrees with a vertical plane. A seat frame 150 may be provided on and carried by the weight rack platform 112 of the frame base 104. The seat frame 150 may include a pair of spaced-apart, vertical side seat frame members 152. A panel 154 may extend between the side seat frame members 152. The panel 154 may conceal the weight rack 136. The seat 156 and the backrest 158 may be mounted on the seat frame panel 154 and/or on the frame upright 124.

In some embodiments, the inner gliders 164, 174 may be connected to the aforementioned weight and resistance pulley system, and the outer gliders 184 may be connected to the aforementioned counterweight resistance weight and pulley system. In other embodiments, the inner gliders 164, 174 may be connected to the counterweight resistance weight and pulley system, and the outer gliders 184 may be connected to the weight and resistance pulley system. Yet further embodiments are contemplated without departing from the scope of the present disclosure.

The inner gliders 164, 174 may include a pair of lower inner gliders 164 pivotally attached to the base glider support 114 on the frame base 104 of the apparatus frame 102. The inner gliders 164, 174 may additionally or alternatively include a pair of upper inner gliders 174 pivotally attached to the lower overhead glider support 130 on the frame upright 124 of the apparatus frame 102. The lower inner gliders 164 and the upper inner gliders 174 may be independently pivotable with respect to the apparatus frame 102.

With reference to FIGS. 1 and 2, in some embodiments, each of the pair of lower inner gliders 164 may include a proximal segment 166, which may extend radially outward relative to the seat 156, and may be sloped upward. A distal segment 168 may extend at an angle from the proximal segment 166, such that the distal segment 168 extends generally upward, such as along the vertical direction z. A mount flange 170 may terminate the proximal segment 166 of each lower inner glider 164. The mount flange 170 may be suitably configured for pivotal attachment to the base glider support 114.

Each of the pair of upper inner gliders 174 may include a proximal segment 176, which may extend radially outward relative to the seat 156, and may be sloped downward. A distal segment 178 may extend at an angle from the proximal segment 176, such that the distal segment 178 extends generally downward, such as along the vertical direction z. The proximal and distal segments 178 may be generally straight and may form an obtuse angle. A mount flange 180 may terminate the proximal segment 176 of each upper inner glider 174. The mount flange 180 may be suitably configured for pivotal attachment to the lower overhead glider support 130 or the upper overhead glider support 132. Free ends of each upper inner glider 174 and corresponding lower inner glider 164 may be arrangeable to face or vertically align with one another, as shown in FIGS. 1 and 2.

Figure 7:
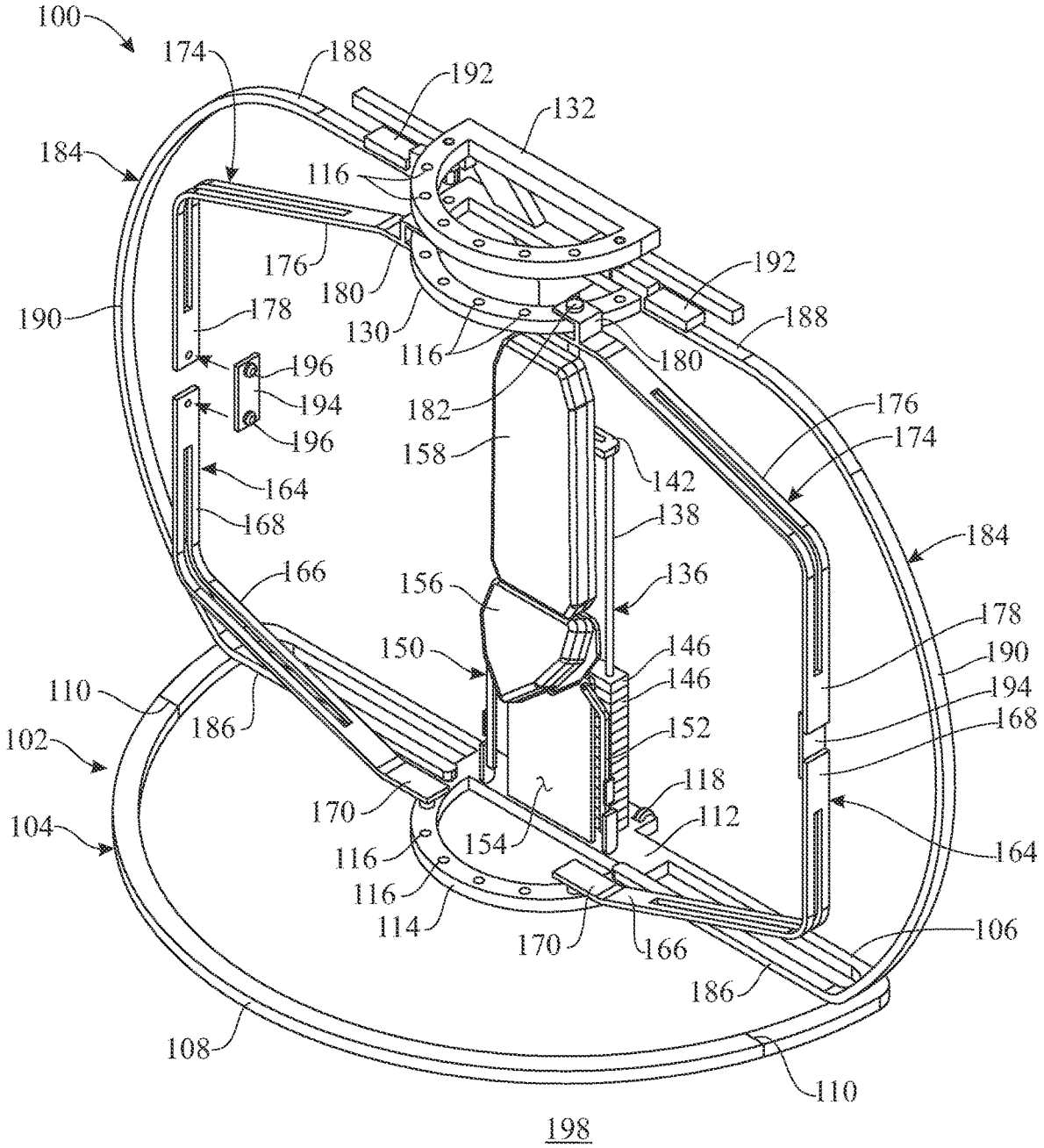
FIG. 7 presents an exploded top front isometric view of the exercise apparatus of FIG. 1, more particularly illustrating attachment of a glider connecting member to each left and right lower inner glider and corresponding left and right upper inner glider to facilitate movement of each lower inner glider and corresponding upper inner glider in concert with each other between the outwardly extended and inwardly retracted positions.
Figure 8:
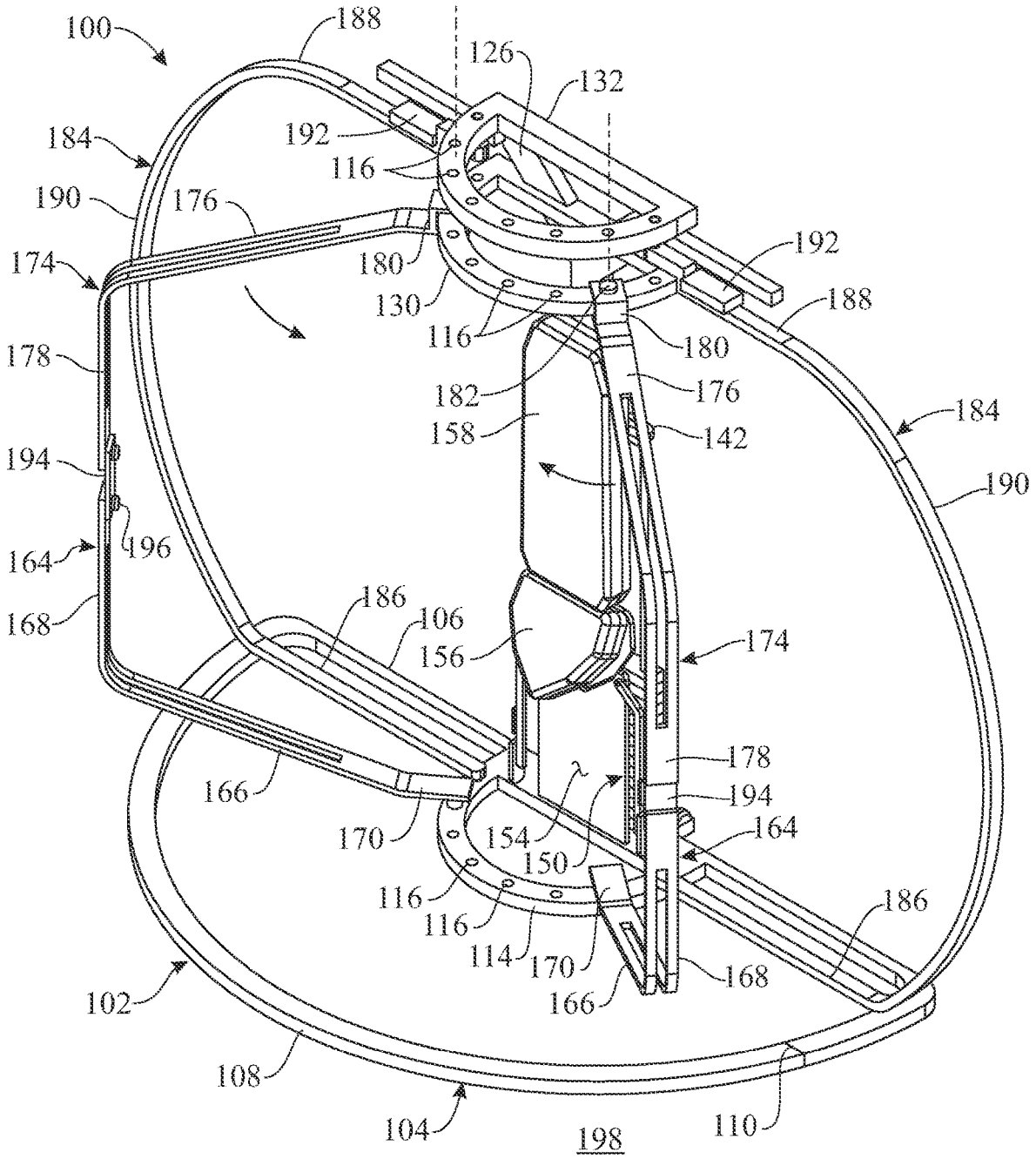
FIG. 8 presents a top front isometric view of the exercise apparatus of FIG. 1, more particularly illustrating movement of each corresponding connected upper and lower inner glider from the outwardly extended position to the inwardly retracted position.

As illustrated in FIGS. 7 and 8, in some embodiments, a glider connecting member 194 may be attached to each left or right upper inner glider 174 and each corresponding left or right lower inner glider 164 to facilitate joint movement of each left or right upper glider 174 with its corresponding left or right lower inner glider 164. In a non-limiting example, the glider connecting member 194 may have a plate shape and may be attached to the upper inner glider 174 and corresponding lower inner glider 164 by fasteners 196.

With reference once more to FIGS. 1 and 2, each of the pair of outer gliders 184 may include a lower glider segment 186 pivotally attached to the base glider support 114, preferably vertically lower than the mount flange 170 of the corresponding lower inner glider 164 (for instance, by having the mount flange 170 pivotably connected to the base glider support 114 by a spacer). An upper glider segment 188 of the outer glider 184 may be pivotally attached to the lower overhead glider support 130 or the upper overhead glider support 132, via a mount flange 192. An outer glider segment 190 may extend between the lower glider segment 186 and the upper glider segment 188. In some embodiments, the outer glider segment 190 of each outer glider 184 may be curved outwardly, as illustrated, and the outer glider 184 may have a substantial C-shape. The lower glider segment 186 and/or upper glider segment 188 may be rectilinear. For instance and without limitation, the lower and upper segments 186 and 188 are rectilinear and parallel to one another, and configured to be arranged horizontally when the exercise apparatus 100 is in the functional configuration.

In an illustrative application, the exercise apparatus 100 may be deployed in the extended, functional configuration illustrated in FIGS. 1-12 for use by an exerciser, and may be placed relatively close to or adjacent to a wall or other structure. The front base segment 108 of the frame base 104 may be extended forward and downward at the respective front base segment hinges 110. The deployed frame base 104 and remaining elements of the apparatus frame 102 impart stability to the exercise apparatus 100 without requiring the exercise apparatus 100 to be secured to the wall. The rear base segment 106 and the front base segment 108 may be placed flat on a floor or other support surface 198 with the frame upright 124 extending vertically from the rear base segment 106 of the frame base 104.

Figure 9:
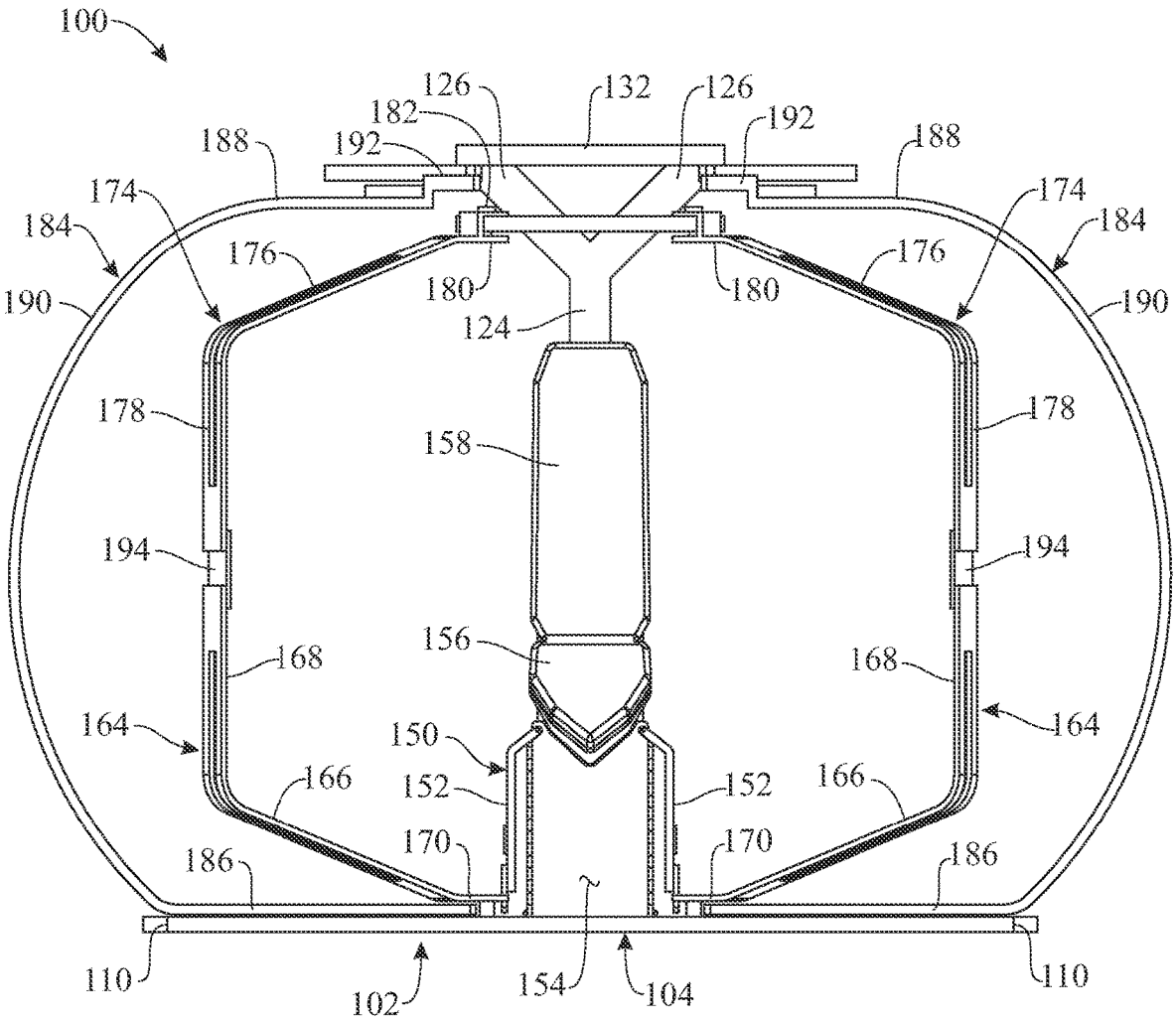
FIG. 9 presents a front elevation view of the exercise apparatus of FIG. 8.

In some applications, the seat 156 may be selectively deployed on the seat frame 150 from the flat, stowage position illustrated in FIGS. 1-6 to the extended, functional position illustrated in FIGS. 7-9. The exerciser may rest part of their weight on the slightly tilted seat 156 while maintaining a standing position, with the exerciser's back resting against the backrest 158. Alternatively, the exerciser may stand on the support surface 198 in front of the seat 156 and the backrest 158, without engaging with the seat 156 and/or backrest 158. The exerciser may select the quantity of weight which is to be lifted by movement of the lower inner gliders 164 or the upper inner gliders 174. This may be accomplished by, for example and without limitation, inserting a weight pin (not illustrated) between a selected pair of the stacked weight plates 146 which correspond to the desired weight in the weight rack 136, according to techniques known in the art.

Figure 5:
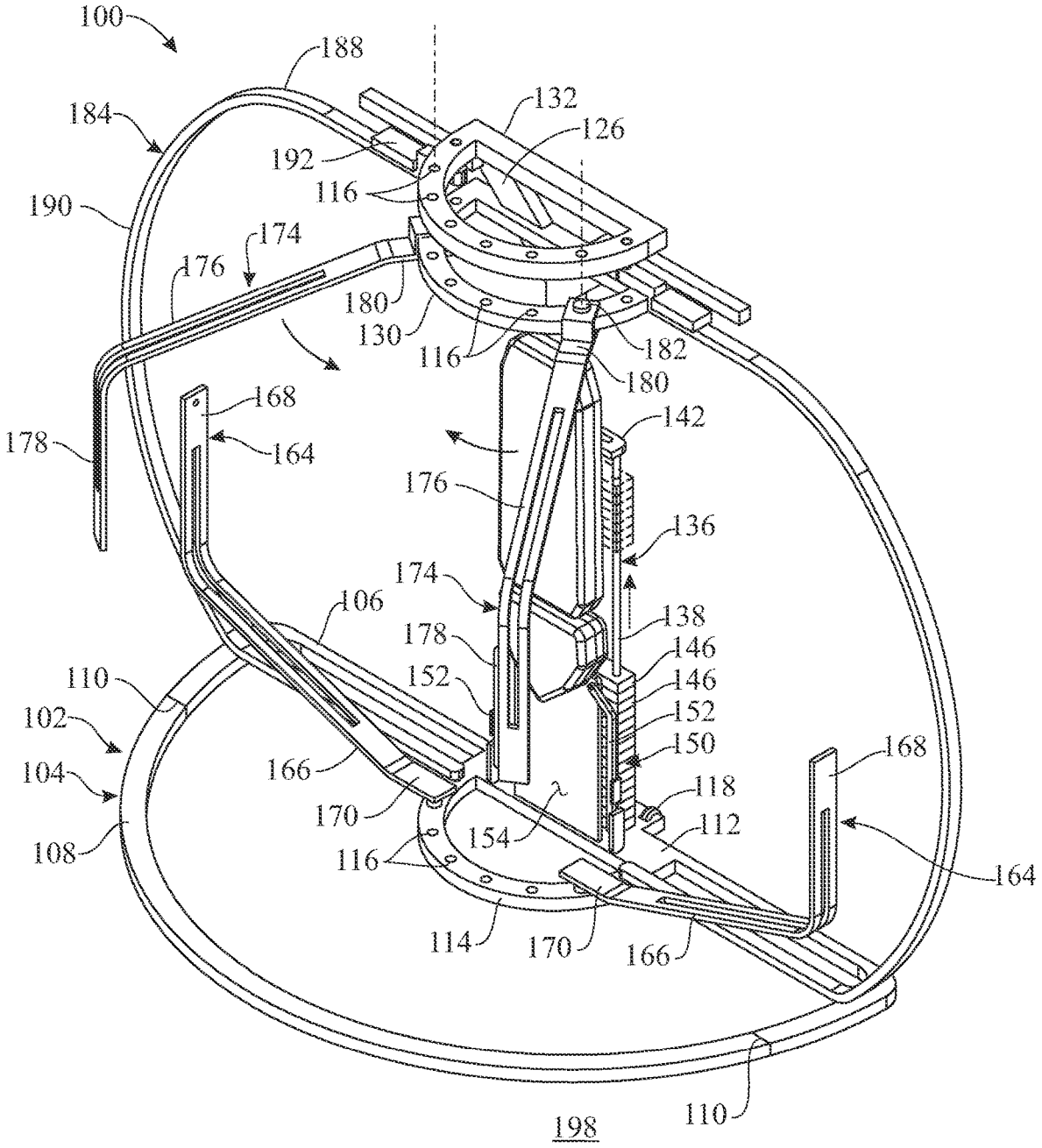
FIG. 5 presents a top front isometric view of the exercise apparatus of FIG. 1, with the outer gliders and the lower inner gliders deployed in the outwardly extended position and the upper inner gliders deployed in the inwardly retracted position.

With the exerciser's hands or forearms placed against the upper inner gliders 174, the exerciser may exert inward pressure against the outward resistance which the weight plates 146 of the weight rack 136 apply against the upper inner gliders 174 to move the upper inner gliders 174 from the fully open or outwardly extended position illustrated in FIGS. 1-3 to a more closed or inwardly retracted position illustrated in FIG. 5. Simultaneously, the weight resistance cable and pulley system may transmit the energy applied by the exerciser on the upper inner gliders 174 to the weight rack 136, thereby raising the selected pinned weight plates 146 on the side rack rails 138 and the center rack rail 140 of the weight rack 136. The exerciser may repeat, this motion a selected number of times to complete one or more sets. Between sets, the exerciser may adjust the number of weight plates 146, and thus, the amount of weight which is lifted each time. The resistance which the weight plates 146 of the weight rack 136 apply against the arms of the exerciser may exercise and develop the arms and chest of the exerciser.

Figure 6:
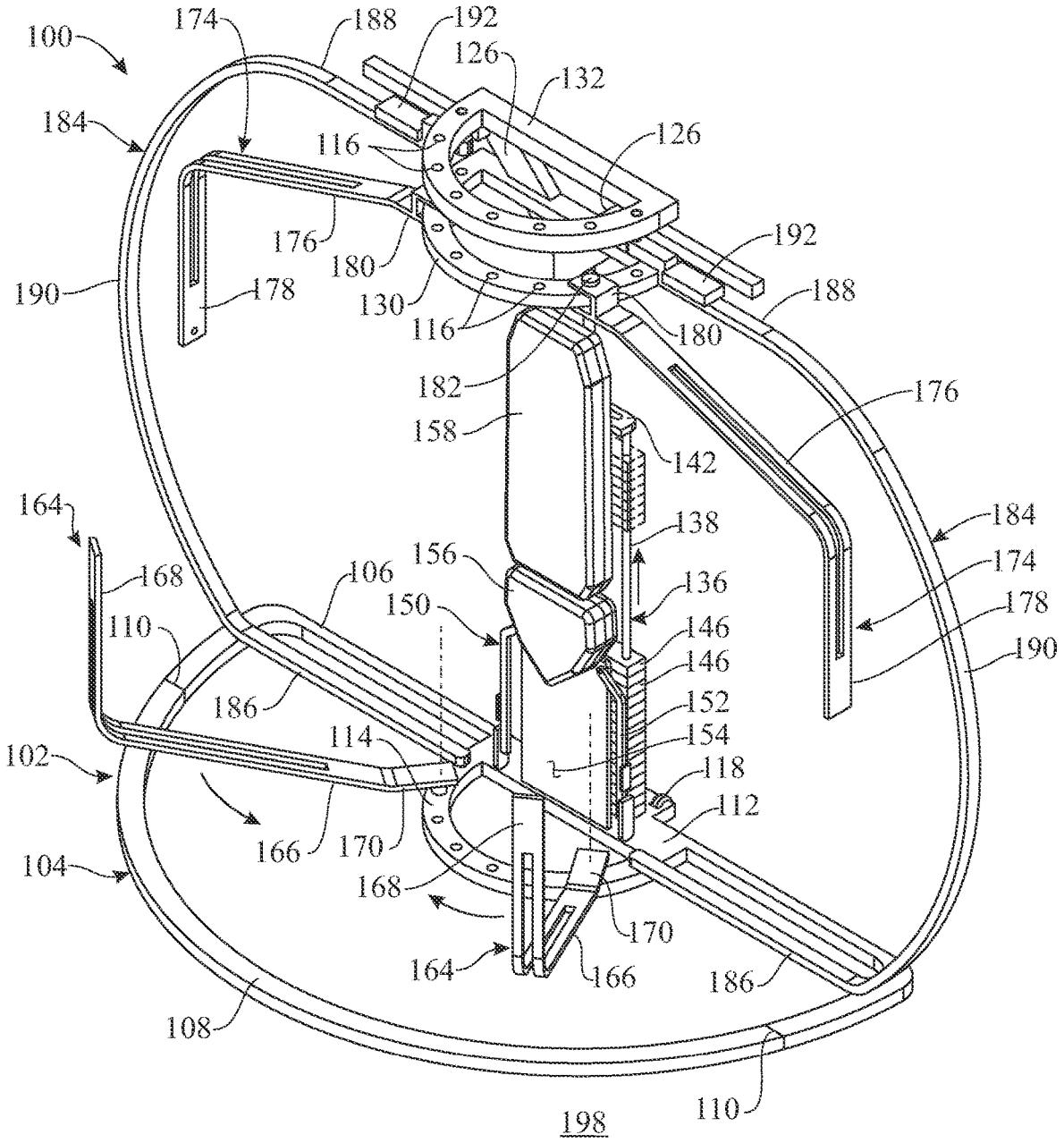
FIG. 6 presents a top front isometric view of the exercise apparatus of FIG. 1, with the outer gliders and the upper inner gliders deployed in the outwardly extend position and the lower inner gliders deployed in the inwardly retracted position.

In some applications, the exerciser may apply the exerciser's feet or legs against the lower inner gliders 164 and move the lower inner gliders 164 in the same motion from the outwardly extended position illustrated in FIGS. 1-3 to the inwardly retracted position illustrated in FIG. 6. The outward resistance which the weight plates 146 of the weight rack 136 apply to the legs of the exerciser may develop the leg muscles of the exerciser. The lower inner gliders 164 and the upper inner gliders 174 may apply weight resistance for sagittal and transverse functionality.

In some applications, the exerciser may choose to interconnect the lower and upper inner gliders 164 and 174 via the glider connecting members 194 and thus operate the lower and upper inner gliders 164 and 174 jointly, such as with both hands and both feet. The resistance that the weight plates 146 of the weight rack 136 apply to the legs and arms of the exerciser via the lower and upper inner gliders 164 and 174 may simultaneously develop the leg, chest and arm muscles, respectively, of the exerciser.

In some applications, the exerciser may exert inward pressure using the exerciser's feet or hands and arms against the outward resistance which the weight plates 146 of the weight rack 136 apply to the outer gliders 184. The exerciser may move the outer gliders 184 from the open or outwardly extended position illustrated in FIGS. 1-3 to a more closed or inwardly retracted position illustrated in FIG. 4. The resistance that the weight plates 146 of the weight rack 136 apply to the legs or arms of the exerciser via the outer gliders 184 may develop the leg or arm muscles, respectively, of the exerciser.

In some applications, the inner gliders 164, 174 and/or the outer gliders 184 may be connected to the weight plates 146 of the weight rack 136 through the counterweight resistance cable and pulley system. The inner gliders 164, 174 and/or the outer gliders 184 may apply a counterweight or balance resistance against the legs or arms of the exerciser. Accordingly, the more weight plates 146 which are stacked on the weight rack 136, the less the resistance applied to the legs or arms of the exerciser. Facilitating an exercise program which offers both weight resistance and counterweight or balance resistance, may contribute to further promote Long Strength Development (LSD) in the exerciser.

When not in use, the exercise apparatus 100 can be selectively deployed from the extended, functional configuration illustrated in FIGS. 1-12 to the folded, transport or storage configuration illustrated in FIGS. 13 and 14. This may be accomplished by folding the front base segment 108 of the frame base 104 at the front base segment hinges 110. As illustrated in FIG. 14, the folded exercise apparatus 100 can be tilted and transported on the wheels 118 along the support surface 198 for space-efficient storage in an appropriate location. In some embodiments, the exercise apparatus 100 may include a handle 200 configured to facilitate a user pulling and pushing of the apparatus to roll and maneuver along the ground. For instance and without limitation, a pair of handle members 202 may extend outward from the frame upright 124, such as in opposite directions along the left-to-right, transverse direction y, as best shown in FIGS. 1 and 3.

Figure 15:
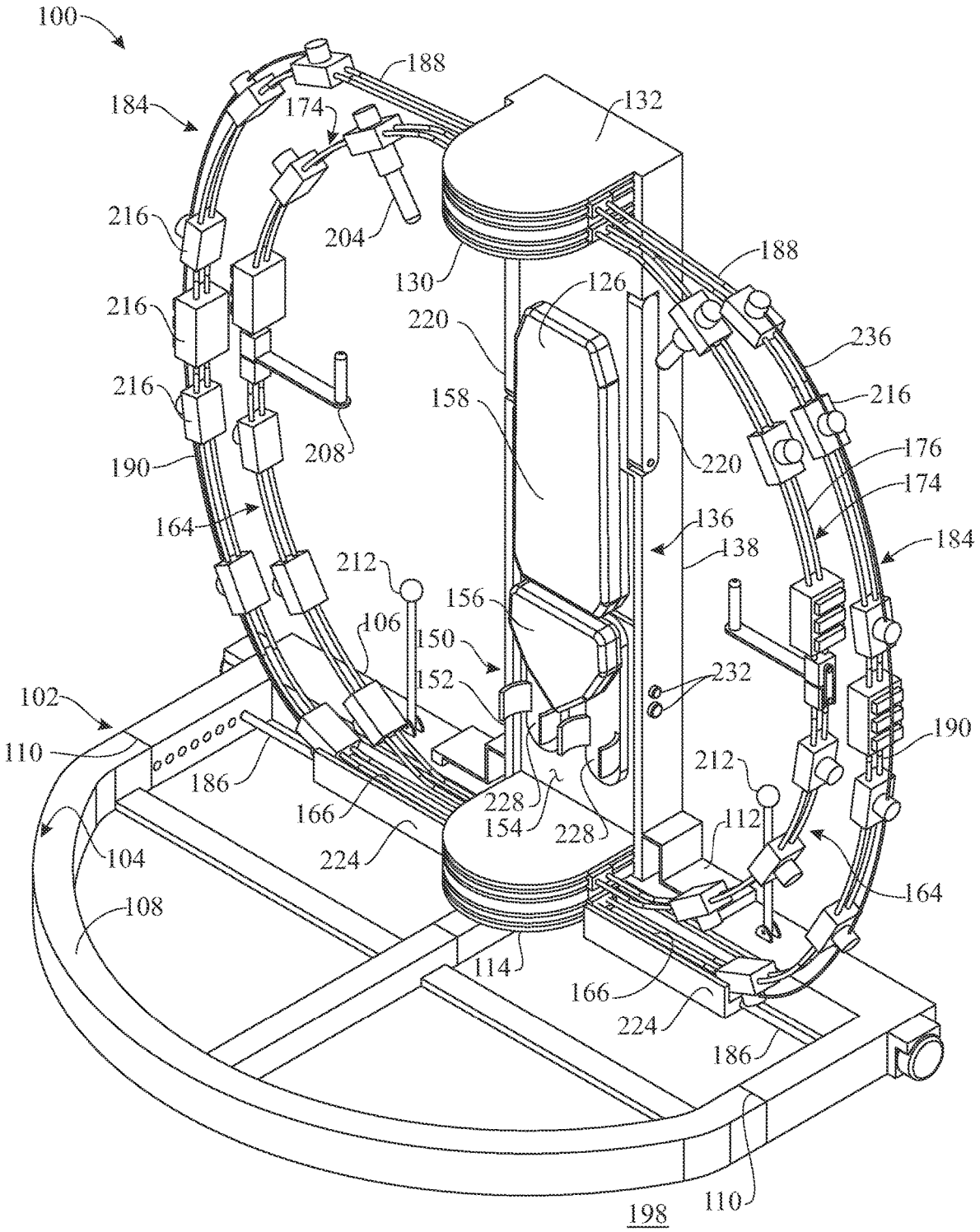
FIG. 15 presents a top front isometric view of an exercise apparatus in accordance with an alternate embodiment of the present invention, with the outer gliders and the inner gliders deployed in the outwardly extended position.

The illustrative embodiments presented in FIGS. 15-21 present additional features of the exercise apparatus 100. Referring initially to FIG. 15, at least two adjustable handle grips 208. Each handle 208 has locked slots of indeterminate length. In the preferred embodiment, the locked slots may be 14 inches. To use the handle grip, the user must first turn a handle grip lever knob 212, which are located on the apparatus frame 102, one for each adjustable handle. The up and down direction of the handle is allowed by the adjustable. The handle adjustment slider which allows the raising and lowering of the handle grip has inseam padding that provide safety and comfort to the user. An alternative interchangeable grip 204 is also provided.

Figure 16:
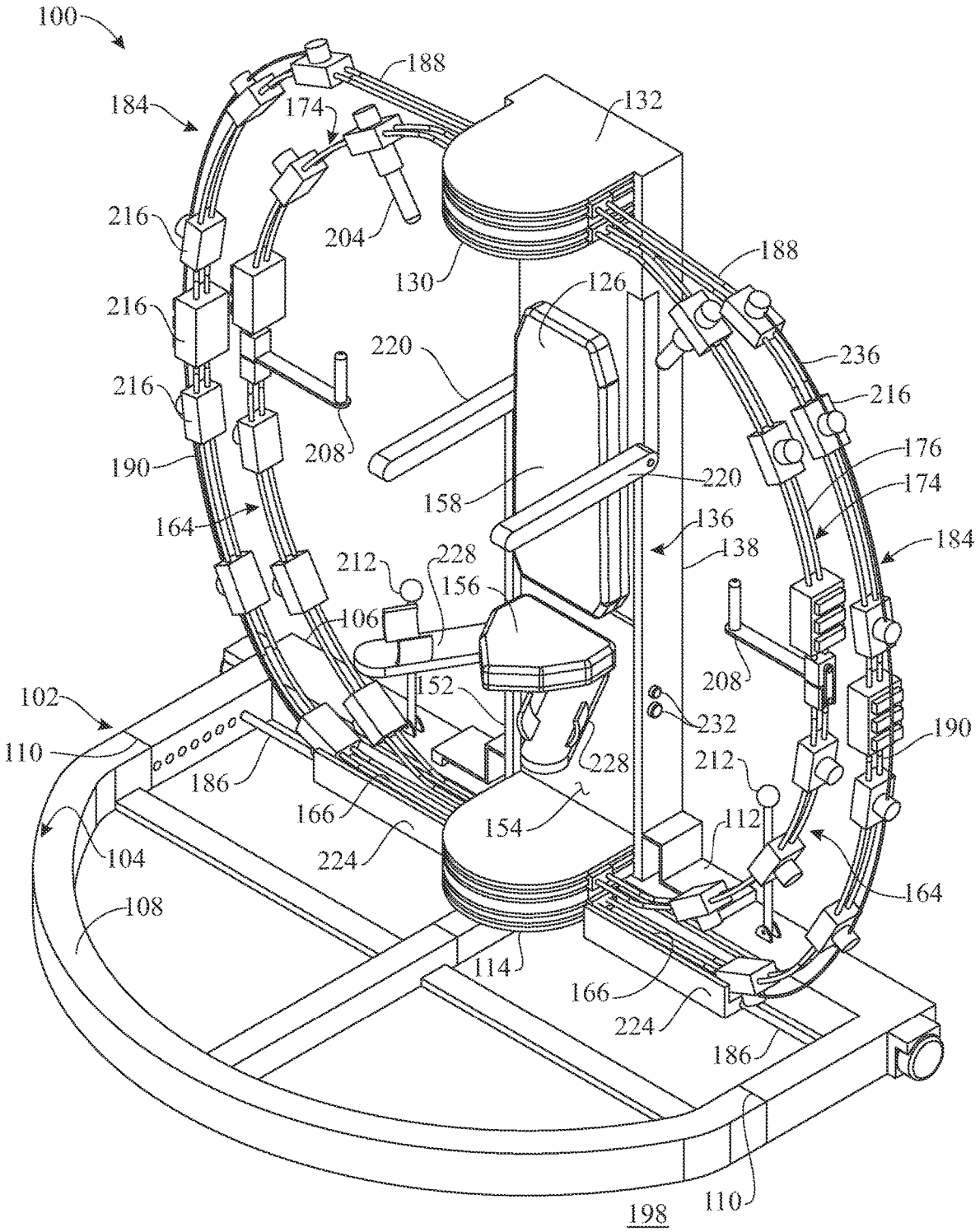
FIG. 16 presents a top front isometric view of the exercise apparatus of FIG. 15, with the arm supports, leg supports, and seat deployed outwardly extended position.
Figure 17:
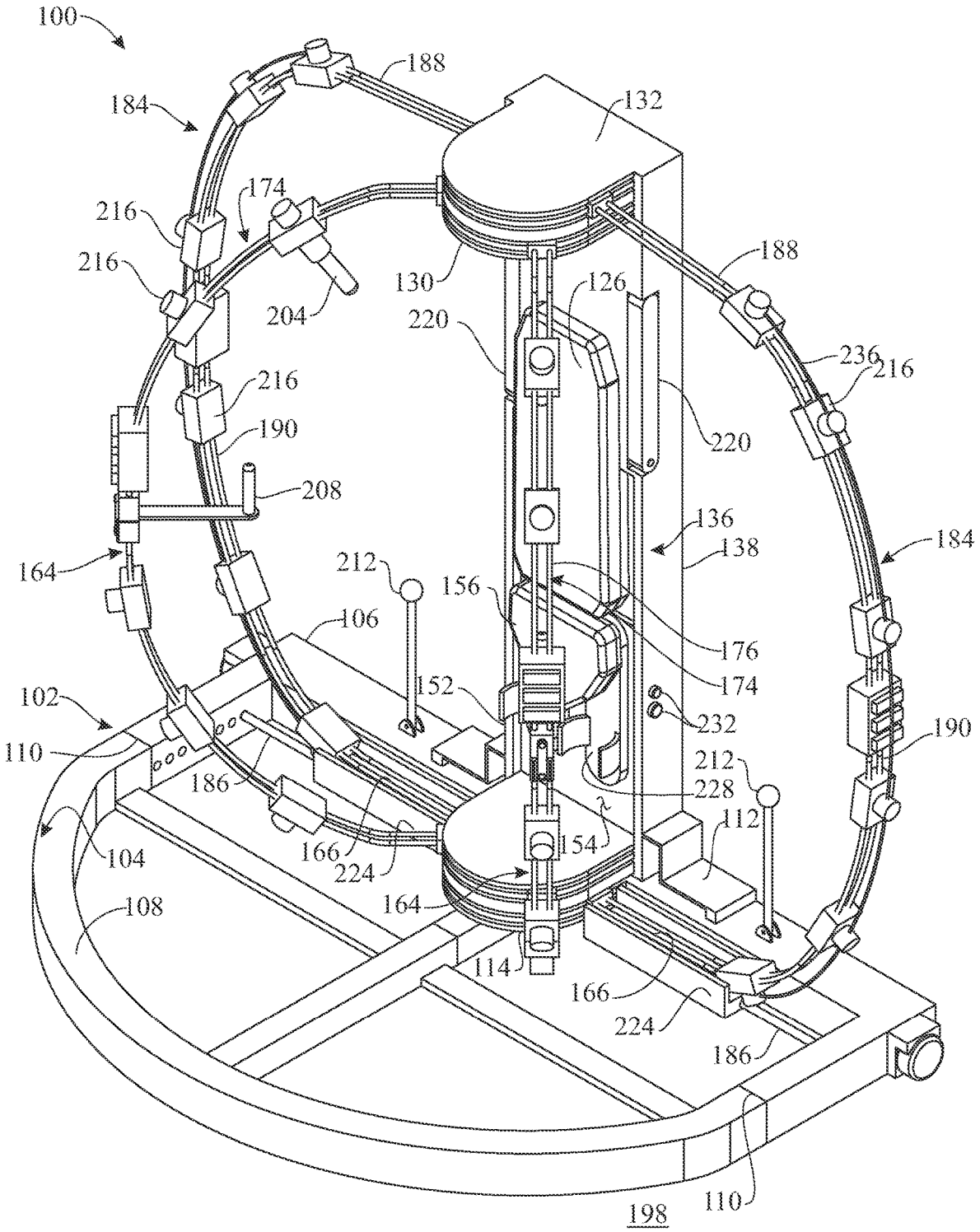
FIG. 17 presents a top front isometric view of the exercise apparatus of FIG. 15, with the outer gliders deployed in the inwardly retracted position and the inner gliders deployed in the outwardly extended position.
Figure 18:
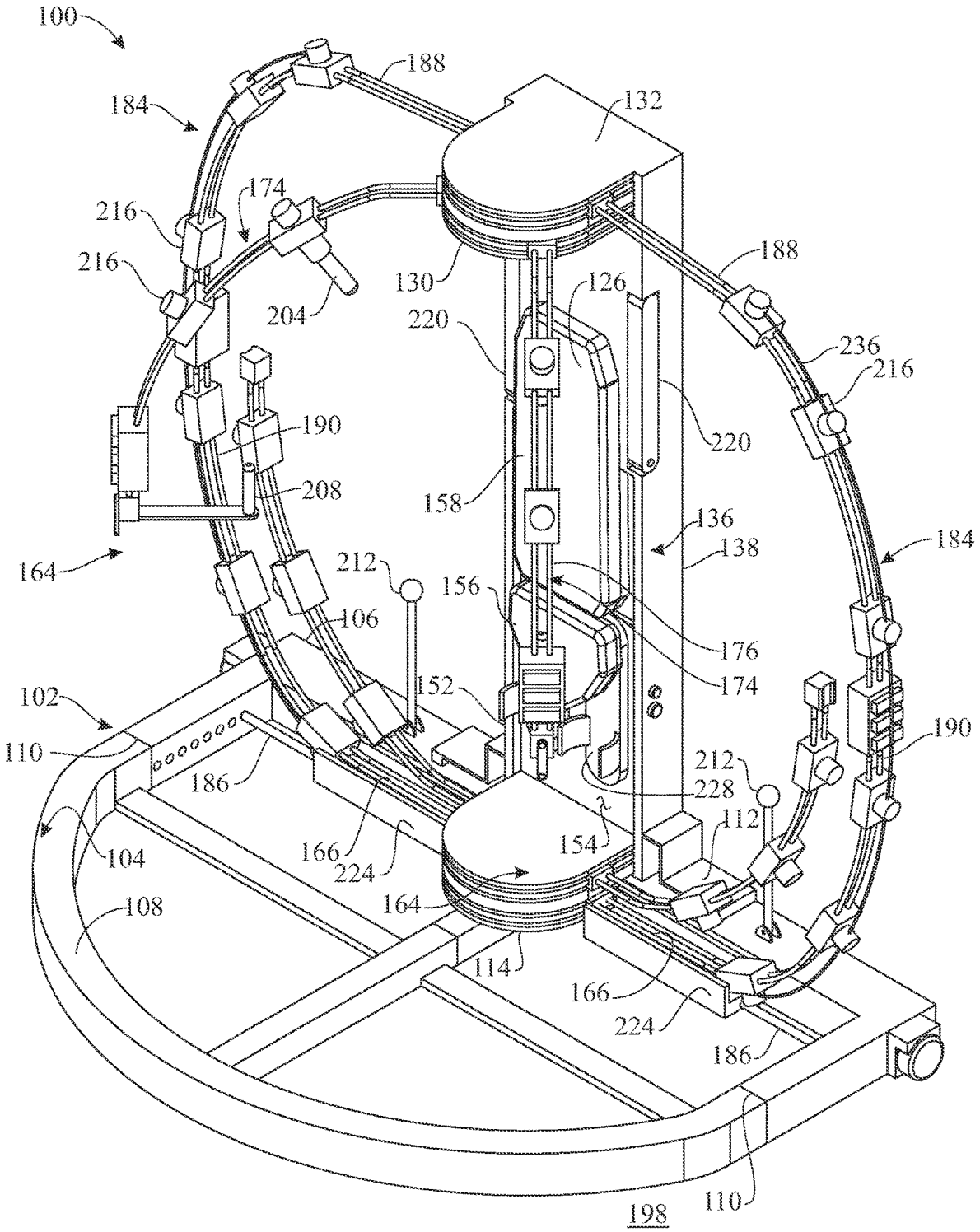
FIG. 18 presents a top front isometric view of the exercise apparatus of FIG. 15, more particularly illustrating movement of each corresponding connected upper and lower inner glider from the outwardly extended position to the inwardly retracted position.
Figure 19:
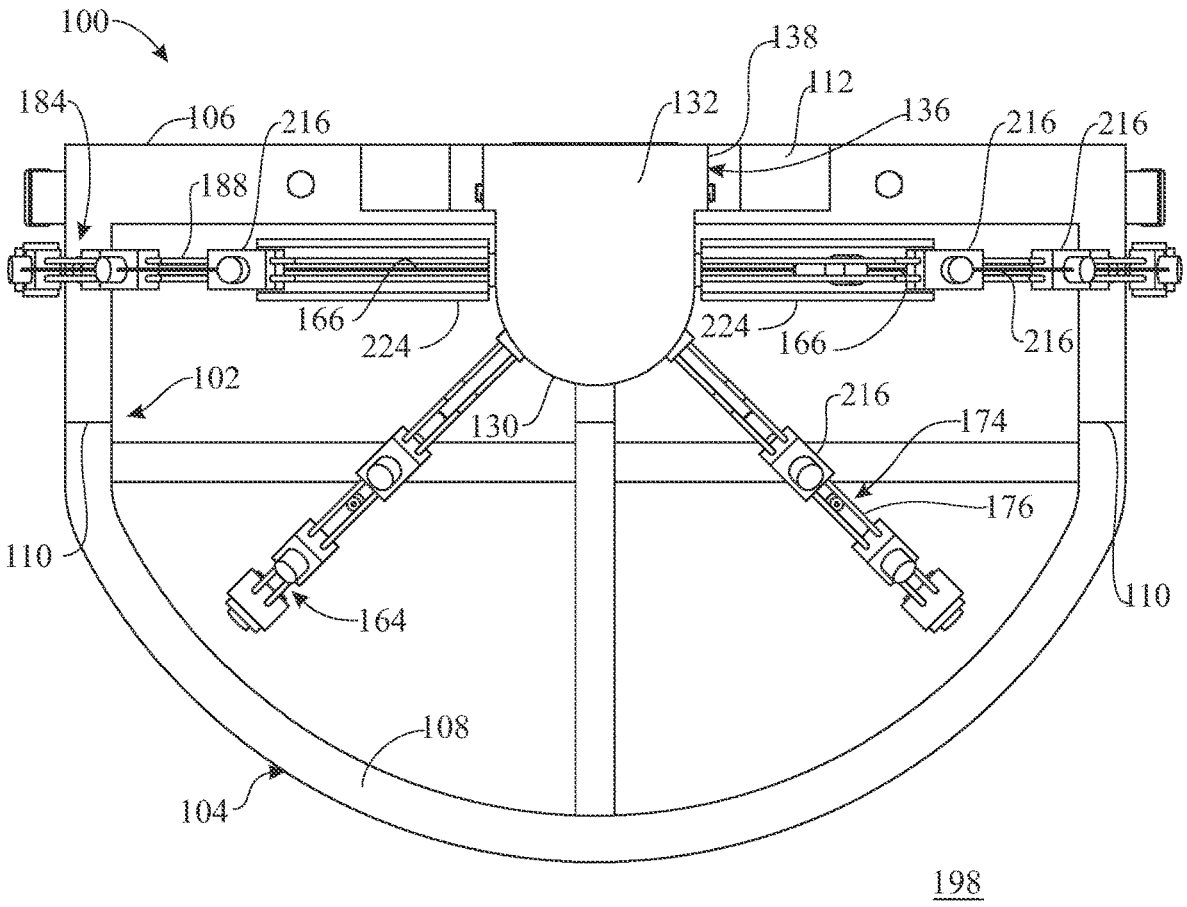
FIG. 19 presents a top plan view of the exercise apparatus of FIG. 15, with the outer and inner gliders deployed in the outwardly extended position.
Figure 20:
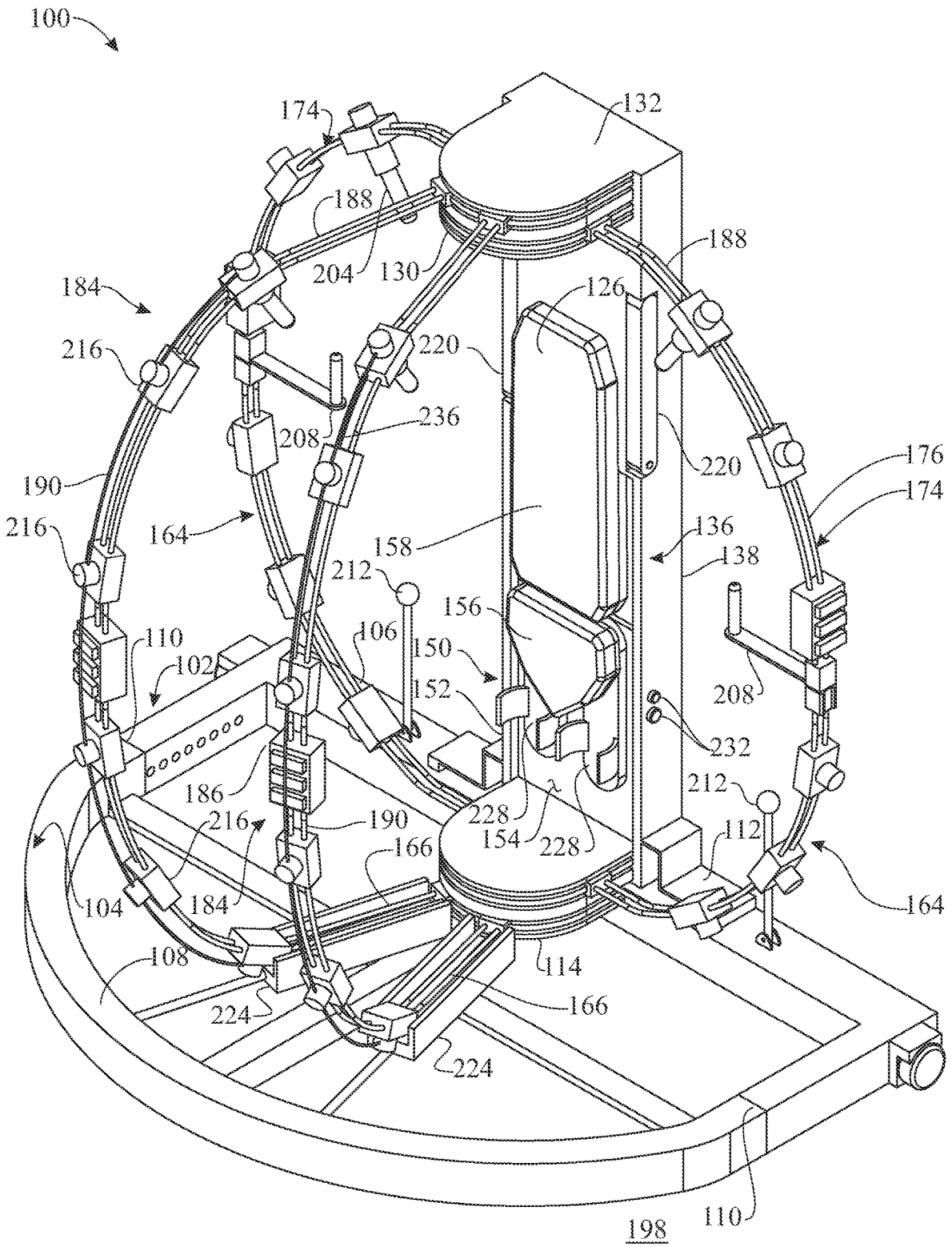
FIG. 20 presents a top front isometric view of the exercise apparatus of FIG. 15, with the outer gliders deployed in the inwardly retracted position and the inner gliders deployed in the outwardly extended position.
Figure 21:
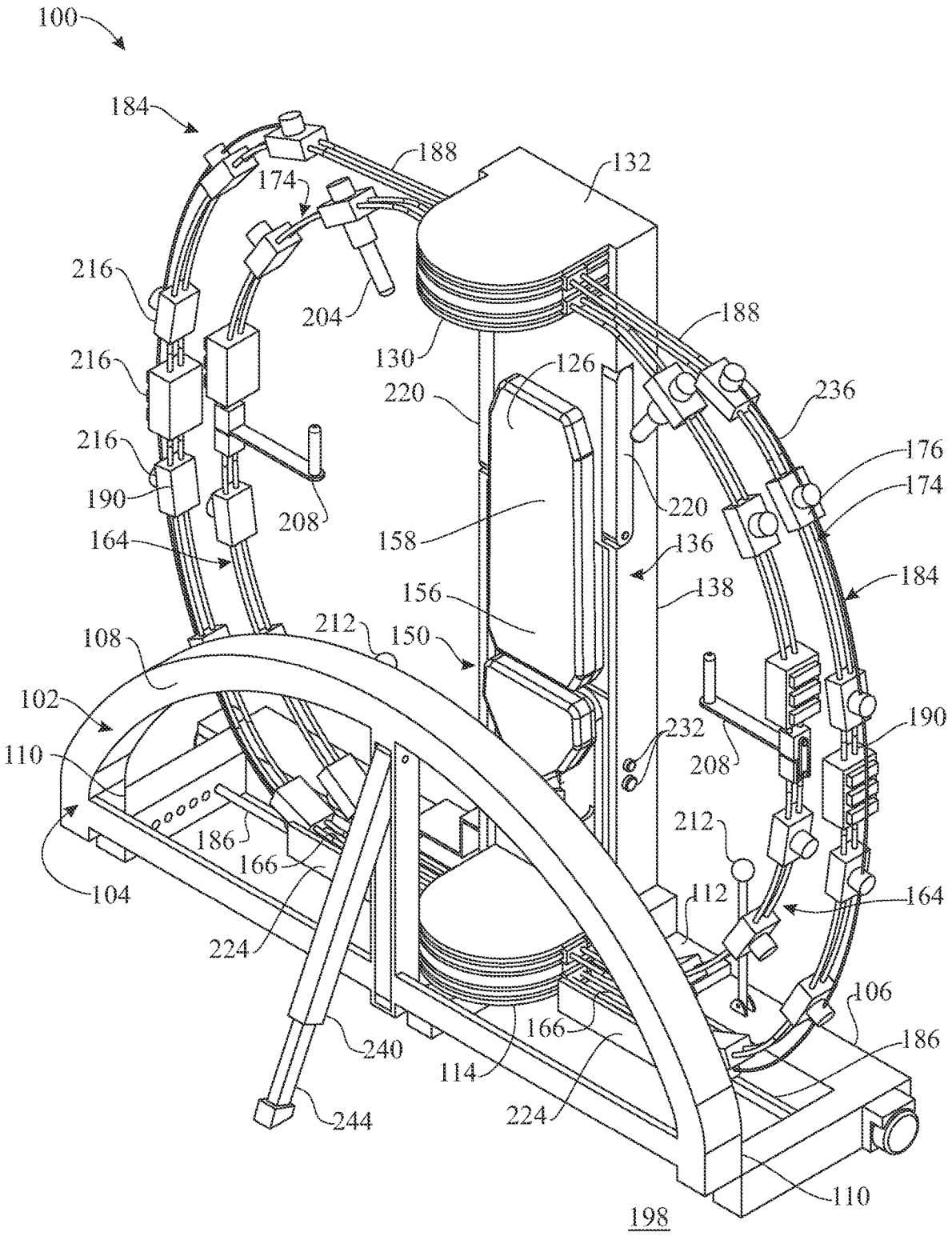
FIG. 21 presents a top front isometric view of the exercise apparatus of FIG. 15, with the platform base folded into a and upward position with the locking arm support deployed.

As best shown in FIG. 16, the frame upright 124, may also include at least arm supports 220 that when extended, sit on each side of the back rest 158. Similarly, at least one leg support 228 may be provided on the frame upright 124 as well. A plurality of guides 224 may be used to adjust the gliders 164, 184. The gliders 164, 174 may be adjusted using adjustable buttons 232 on the frame upright 124. Movement may be facilitated by glider connecting cables 236. Additionally, both gliders 164, 184 may include a plurality of locks 164 placed throughout the length of each of the gliders 164, 184. This feature for transverse workouts by allow the user's upper body to go one direction while the lower half can be locked or have the option of rotating the other direction As best shown in FIG. 21 the frame base 104 may be foldable and may include a locking arm support 240. The locking arm support 240 may include an extendable member which extended out of the support 240 to rest on the ground.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An exercise apparatus suitable for promoting muscle development in an exerciser, comprising:

an apparatus frame;

at least one pair of left and right outer gliders pivotally carried by the apparatus frame;

at least one pair of left and right inner gliders pivotally carried by the apparatus frame inside the at least one pair of left and right outer gliders, the outer gliders and the inner gliders independently positional between an outwardly extended position and an inwardly retracted position; and a weight rack carried by the apparatus frame, the weight rack selectively connectable to the inner and outer gliders.

2. The exercise apparatus of claim 1, wherein at least one cable and pulley system connect a weight plate of the weight rack to the outer gliders and the inner gliders, and further wherein the cable and pulley system includes a weight resistance cable and pulley system which connects the weight plates to a first one of the inner gliders and the outer gliders and a counterweight resistance cable and pulley system which connects the weight plates to a second one of the inner gliders and the outer gliders.

3. The exercise apparatus of claim 1, wherein the first one of the outer gliders and the inner gliders utilize weight resistance for sagittal and transverse functionality, and a second one of the outer gliders and the inner gliders utilize counterweight or balance resistance, to impart resistance to the arms and/or legs of the exerciser.

4. The exercise apparatus of claim 1, wherein the apparatus frame includes a frame base and a frame upright extending upwardly from the frame base, and further wherein the outer gliders and the inner gliders are pivotally mounted on the frame base and the frame upright.

5. The exercise apparatus of claim 4, wherein the frame base of the apparatus frame includes a rear base segment and a front base segment extending from the rear base segment.

6. The exercise apparatus of claim 5, wherein the rear base segment is straight and elongated and the front base segment is curved.

7. The exercise apparatus of claim 1, wherein the exercise apparatus may be selectively deployable in an extended, functional configuration and a folded, transport or storage configuration.

8. The exercise apparatus of claim 5, wherein a pair of front base segment hinges are provided in the front base segment to facilitate selective deployment of the exercise apparatus in the extended, functional configuration and the folded, transport or storage configuration.

9. The exercise apparatus of claim 8, wherein the frame upright extends from substantially the midpoint of the rear base segment of the frame base.

10. The exercise apparatus of claim 5, wherein a weight rack platform is provided on the rear base segment of the frame base, and the weight rack is provided on the weight rack platform behind the frame upright.

11. The exercise apparatus of claim 10, wherein the weight rack includes at least one vertical rack rail, and the weight plates are slidably mounted on the at least one rack rail.

12. The exercise apparatus of claim 1, wherein the apparatus frame includes at least one glider support, and the outer gliders and the inner gliders are pivotally attached to the at least one glider support.

13. The exercise apparatus of claim 4, wherein the at least one glider support includes a base glider support on the frame base of the apparatus frame, and further wherein the at least one glider support includes at least one overhead glider support on the frame upright.

14. The exercise apparatus of claim 13, wherein the at least one glider support includes a lower overhead glider support and an upper overhead glider support, and the inner gliders are pivotally attached to the lower overhead glider support and the outer gliders are pivotally attached to the upper overhead glider support.

15. The exercise apparatus of claim 14, wherein a pair of frame arms extend upwardly from the frame upright, and the lower overhead glider support and the upper overhead glider support are supported by the frame arms.

16. The exercise apparatus of claim 14, wherein the inner gliders include a pair of lower inner gliders pivotally attached to the base glider support on the frame base of the apparatus frame, and further wherein the inner gliders include a pair of upper inner gliders pivotally attached to the lower overhead glider support on the frame upright of the apparatus frame.

17. The exercise apparatus of claim 16, wherein the inner gliders may include a pair of lower inner gliders pivotally attached to the base glider support on the frame base and a pair of upper inner gliders pivotally attached to the lower overhead glider support on the frame upright of the apparatus frame.

18. The exercise apparatus of claim 17, wherein the lower inner gliders and the upper inner gliders may be independently pivotal with respect to the apparatus frame.

19. An exercise apparatus suitable for promoting muscle development in an exerciser, comprising:

an apparatus frame, wherein the apparatus frame includes a frame base and a frame upright extending upwardly from the frame base, and further wherein the outer gliders and the inner gliders are pivotally mounted on the frame base and the frame upright;

at least one pair of left and right outer gliders pivotally carried by the apparatus frame;

at least one pair of left and right inner gliders pivotally carried by the apparatus frame inside the at least one pair of left and right outer gliders, the outer gliders and the inner gliders independently positional between an outwardly extended position and an inwardly retracted position; and a weight rack carried by the apparatus frame, the weight rack selectively connectable to the inner and outer gliders, wherein a weight rack platform is provided on a rear base segment of the frame base, and the weight rack is provided on the weight rack platform behind the frame upright.

20. An exercise apparatus suitable for promoting muscle development in an exerciser, comprising:

an apparatus frame, wherein the apparatus frame includes a frame base and a frame upright extending upwardly from the frame base, and further wherein the outer gliders and the inner gliders are pivotally mounted on the frame base and the frame upright;

at least one pair of left and right outer gliders pivotally carried by the apparatus frame;

at least one pair of left and right inner gliders pivotally carried by the apparatus frame inside the at least one pair of left and right outer gliders, the outer gliders and the inner gliders independently positional between an outwardly extended position and an inwardly retracted position, wherein the inner gliders include a pair of lower inner gliders pivotally attached to the base glider support on the frame base of the apparatus frame, and further wherein the inner gliders include a pair of upper inner gliders pivotally attached to the lower overhead glider support on the frame upright of the apparatus frame; and a weight rack carried by the apparatus frame, the weight rack selectively connectable to the inner and outer gliders, wherein a weight rack platform is provided on a rear base segment of the frame base, and the weight rack is provided on the weight rack platform behind the frame upright.

* * * * *